US012454811B2

(12) United States Patent
Yagyu et al.

(10) Patent No.: US 12,454,811 B2
(45) Date of Patent: Oct. 28, 2025

(54) WORKING MACHINE

(71) Applicant: Kubota Corporation, Osaka (JP)

(72) Inventors: Sumio Yagyu, Sakai (JP); Tsunehiro Ii, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 18/743,190

(22) Filed: Jun. 14, 2024

(65) Prior Publication Data

US 2025/0067022 A1 Feb. 27, 2025

(30) Foreign Application Priority Data

Aug. 24, 2023 (JP) ..... 2023-136201

(51) Int. Cl.
*E02F 9/20* (2006.01)
*E02F 9/08* (2006.01)
*E02F 9/22* (2006.01)

(52) U.S. Cl.
CPC ..... *E02F 9/2075* (2013.01); *E02F 9/0866* (2013.01); *E02F 9/226* (2013.01)

(58) Field of Classification Search
CPC ..... E02F 9/0866; E02F 9/2075; E02F 9/2203; E02F 9/2246; E02F 9/226
See application file for complete search history.

(56) References Cited

U.S. PATENT DOCUMENTS

| | | | | |
|---|---|---|---|---|
| 9,722,473 | B2 * | 8/2017 | Buschmann | E01C 19/48 |
| 11,142,887 | B2 * | 10/2021 | Watanabe | B60H 1/00278 |
| 11,673,451 | B2 * | 6/2023 | Spangler | E02F 9/16 180/65.275 |
| 11,987,130 | B2 * | 5/2024 | Clowes | B60H 1/22 |
| 2017/0284062 | A1 * | 10/2017 | Osaka | B60L 3/0046 |
| 2023/0295896 | A1 * | 9/2023 | Takaki | E02F 9/163 296/190.01 |

FOREIGN PATENT DOCUMENTS

JP 2023-020294 A 2/2023

* cited by examiner

*Primary Examiner* — Michael Leslie
(74) *Attorney, Agent, or Firm* — Keating & Bennett, LLP

(57) ABSTRACT

A working machine includes a working device, a hydraulic system including an actuator, and a hydraulic pump to supply a hydraulic fluid to the actuator, an electric device, a power generator to generate electric power to be directly or indirectly supplied to the electric device, a first cooling system to cool the electric device with a first cooling medium, and a second cooling system to cool the power generator with a second cooling medium. The first cooling system includes a first heat exchanger to cool the hydraulic fluid through heat exchange with the first cooling medium, a second heat exchanger to cool the second cooling medium through heat exchange with the first cooling medium, and a third heat exchanger to cool the first cooling medium through heat exchange with outside air to a temperature lower than temperatures before the heat exchange of the hydraulic fluid and the second cooling medium.

20 Claims, 9 Drawing Sheets

WORKING MACHINE

CROSS REFERENCE TO RELATED APPLICATIONS

This application claims the benefit of priority to Japanese Patent Application No. 2023-136201 filed on Aug. 24, 2023. The entire contents of this application are hereby incorporated herein by reference.

BACKGROUND OF THE INVENTION

1. Field of the Invention

The present invention relates to working machines each including a hydraulic system that actuates a working device and a cooling system that cools an electric device.

2. Description of the Related Art

Some working machines such as construction machines and agricultural machines drive a hydraulic pump of a hydraulic system that actuates a working device, and a traveling device by an electric motor (for example, see Japanese Unexamined Patent Application Publication No. 2023-20294).

Such a working machine includes a heat exchanger that cools a hydraulic fluid flowing through the hydraulic system and a heat exchanger that cools a cooling medium for cooling an electric device such as the electric motor. That is, this type of working machine includes a plurality of components that generate heat during driving (during operation). Hence, the working machine includes a plurality of cooling systems for cooling these components to appropriate temperatures, and a heat exchanger is provided in each cooling system.

SUMMARY OF THE INVENTION

Meanwhile, the plurality of heat exchangers provided in the working machine are gas-liquid heat exchangers (so-called radiators) that each exchange heat between a cooling target (for example, cooling water, hydraulic fluid, or the like) and outside air. Hence, each of the plurality of heat exchangers is disposed at a position at which the outside air can be taken in. Also, this type of heat exchanger requires a cooling fan that forcibly sends the outside air toward the heat exchanger in order to exchange heat between a medium serving as the cooling target and the outside air.

As a result, the arrangement of the plurality of heat exchangers limits the layout of another device. Also, in this type of heat exchanger, in order to increase heat exchange efficiency, the heat exchanger needs to be increased in size, and the cooling fan is required. Hence, the occupancy of each heat exchanger increases.

Accordingly, example embodiments of the present invention provide working machines that each increase the flexibility of the arrangement of heat exchangers of a plurality of cooling systems and make the plurality of cooling systems compact.

A working machine according to an example embodiment of the present invention includes a working device, a hydraulic system including an actuator to actuate the working device and a hydraulic pump to supply a hydraulic fluid to the actuator, at least one electric device, a power generator to generate electric power to be directly or indirectly supplied to the at least one electric device, a first cooling system to cause a first cooling medium to circulate therethrough to cool the at least one electric device, and a second cooling system to cause a second cooling medium to circulate therethrough to cool the power generator. The first cooling system includes a first heat exchanger to exchange heat between the hydraulic fluid and the first cooling medium to cool the hydraulic fluid, a second heat exchanger to exchange heat between the first cooling medium and the second cooling medium to cool the second cooling medium, and a third heat exchanger to exchange heat between the first cooling medium and outside air to cool the first cooling medium so that a temperature of the first cooling medium becomes lower than temperatures before the heat exchange of the hydraulic fluid and the second cooling medium.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

DETAILED DESCRIPTION OF THE EXAMPLE EMBODIMENTS

Figure 1:
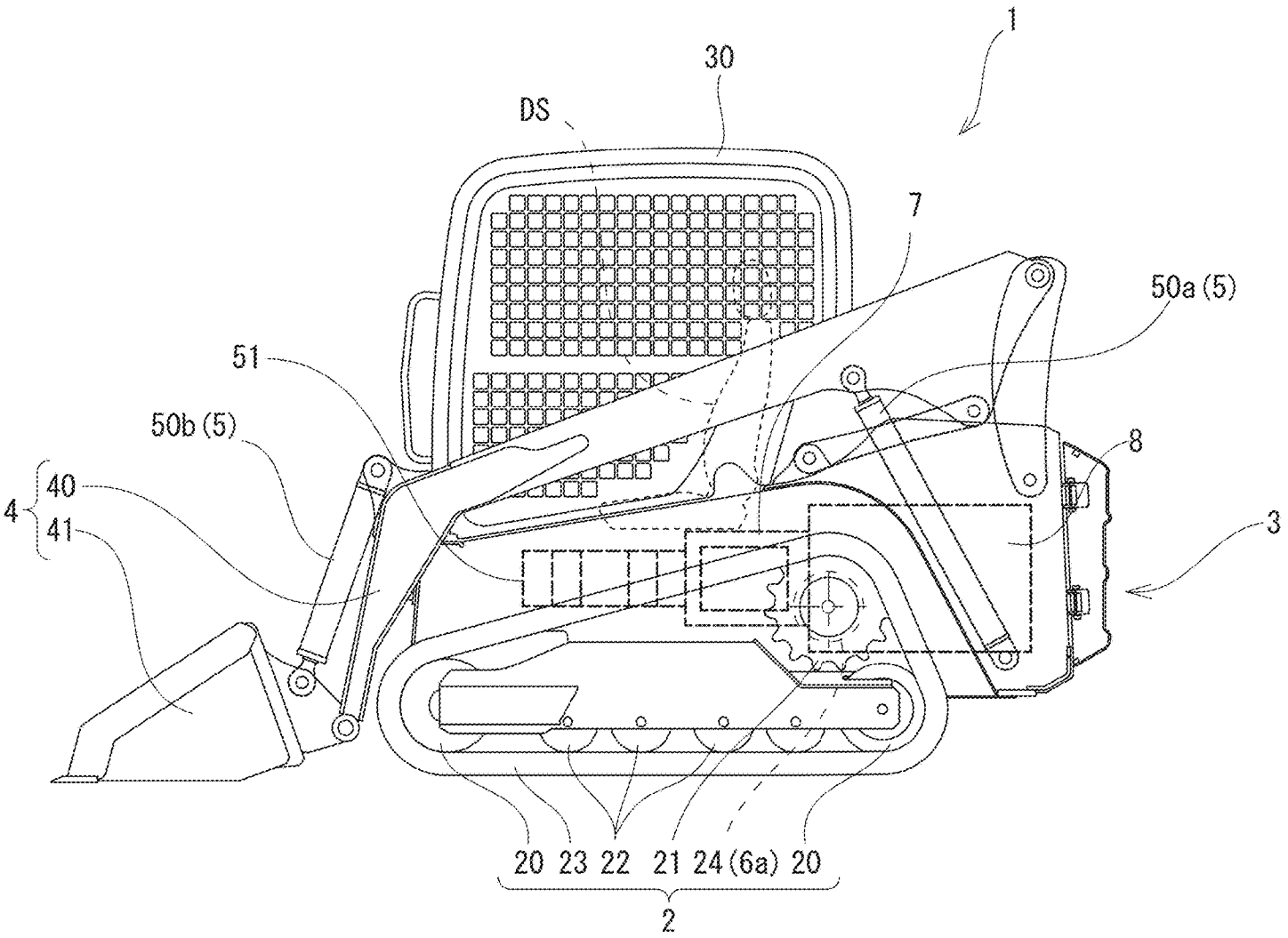
FIG. 1 is a side view of a working machine according to an example embodiment of the present invention.

Example embodiments will now be described with reference to the accompanying drawings, wherein like reference numerals designate corresponding or identical elements throughout the various drawings. The drawings are to be viewed in an orientation in which the reference numerals are viewed correctly.

Hereinafter, example embodiments of the present invention will be described with reference to the drawings as appropriate.

As illustrated in FIG. 1, a working machine 1 includes at least one traveling device 2 and a machine body 3 supported by the traveling device 2. Additionally, the working machine 1 includes a working device 4 to perform predetermined work, and a hydraulic system 5 (see FIG. 2) including actuators 50*a* and 50*b* that actuate the working device 4, and a hydraulic pump 51 that supplies a hydraulic fluid to the actuators 50*a* and 50*b*. Further, the working machine 1 includes at least one of electric devices 6*a*, 6*b*, and 6*c* (see FIGS. 1 to 3), and a power generator 7 that generates electric power to be directly or indirectly supplied to the electric devices 6*a*, 6*b*, and 6*c*. Accordingly, the working machine 1 according to the present example embodiment includes an internal combustion engine 8 that drives the power generator 7.

Figure 2:
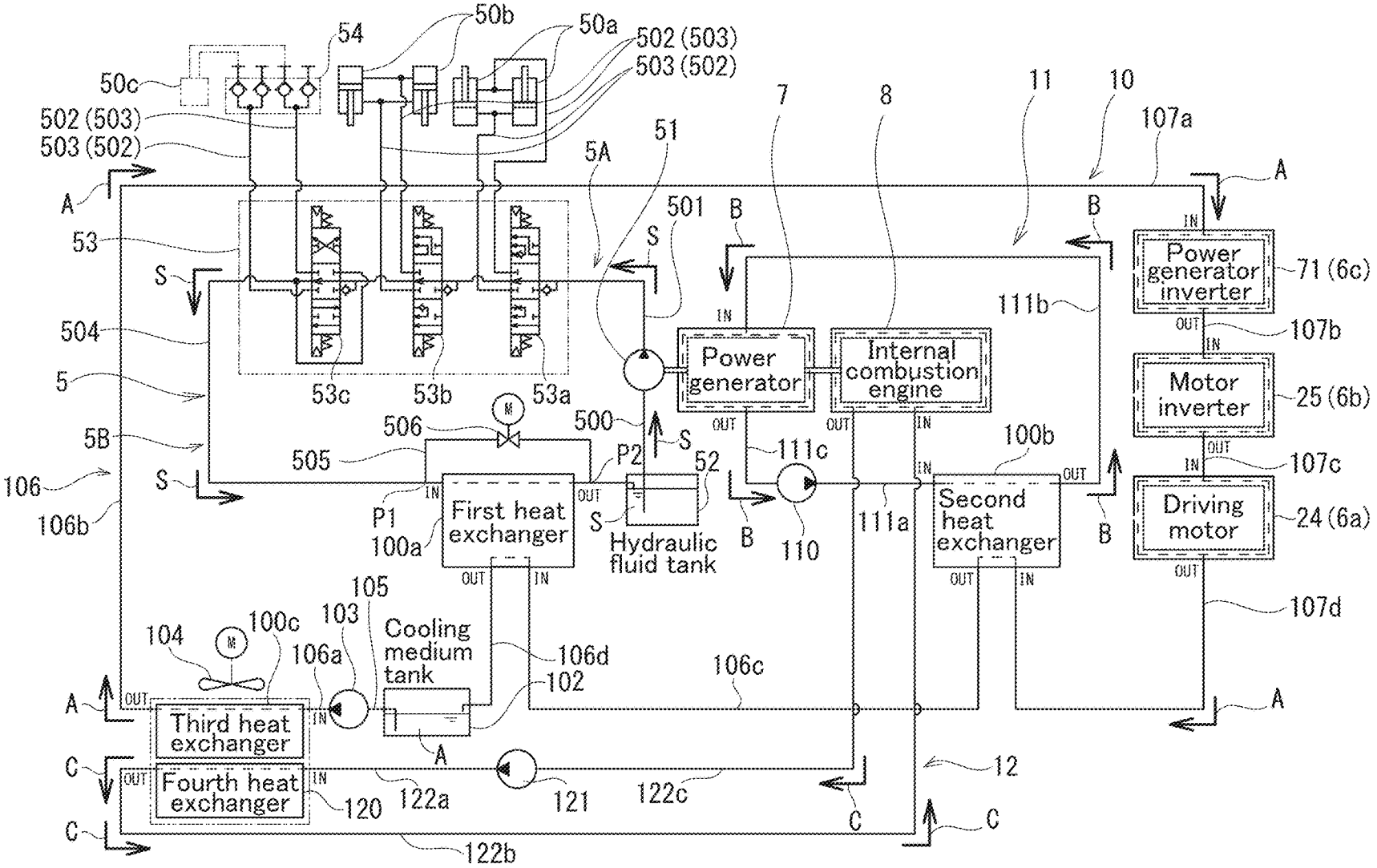
FIG. 2 is a schematic system diagram including a hydraulic system, a first cooling system, a second cooling system, and a third cooling system of the working machine according to an example embodiment of the present invention.

As illustrated in FIG. 2, since the working machine 1 according to the present example embodiment includes the electric devices 6*a*, 6*b*, and 6*c* and the power generator 7, the working machine 1 includes a first cooling system 10 that causes a first cooling medium A to circulate therethrough to cool the electric devices 6*a*, 6*b*, and 6*c*, and a second cooling system 11 that causes a second cooling medium B to circulate therethrough to cool the power generator 7.

Returning to FIG. 1, the traveling device 2 is disposed on each of both sides (both left and right sides) of the machine body 3 in a direction (hereinafter referred to as a width direction) orthogonal to a straight traveling direction (a direction in which the machine body 3 travels forward and backward straight: hereinafter referred to as a front-rear direction). That is, the working machine 1 includes a pair of traveling devices 2 coupled to the machine body 3, and the pair of traveling devices 2 are disposed on both left and right sides (symmetrically) with the machine body 3 interposed therebetween.

In the present example embodiment, a crawler traveling device is used as each of the pair of traveling devices 2. Accordingly, each of the pair of traveling devices 2 includes at least one idler 20, a driving wheel 21, a plurality of rollers 22, an endless annular crawler belt 23, and a driving motor 24.

Each of the pair of traveling devices 2 includes a pair of idlers 20. The pair of idlers 20 are disposed at an interval in the front-rear direction. Each of the pair of idlers 20 is rotatable about an axis extending in the width direction. Each of the plurality of rollers 22 is rotatable about an axis extending in the width direction, similarly to the idler 20. The plurality of rollers 22 are disposed between the pair of idlers 20 at intervals in the front-rear direction.

The driving wheel 21 is disposed between the pair of idlers 20. In the present example embodiment, the driving wheel 21 is disposed higher than the plurality of rollers 22 between the pair of idlers 20. The driving wheel 21 is rotatable about an axis extending in the width direction. The driving wheel 21 has a plurality of engagement teeth on the outer periphery thereof, which engage with the crawler belt 23. The driving wheel 21 is driven to rotate about the axis by receiving drive from the driving motor 24 that is a drive source.

The driving motor 24 is an electric motor as the electric device 6*a*. In the present example embodiment, the driving motor 24 is a three-phase AC synchronous motor including one or more permanent magnets. Note that the driving motor 24 (6*a*) may be another type synchronous motor, and may be an AC motor or a DC motor.

The driving motor 24 (6*a*) includes a housing and a motor main body housed in the housing. In the present example embodiment, the driving motor 24 (6*a*) is a liquid-cooled motor, and includes a passage through which the first cooling medium A flows as illustrated in FIG. 2. The passage includes a start end (IN) serving as an inlet for the first cooling medium A and a terminal end (OUT) serving as an outlet for the first cooling medium A. The inlet (IN) and the outlet (OUT) are configured to be connectable to a pipe defining the passage through which the first cooling medium A flows. Note that the passage of the driving motor 24 includes a cavity formed in a peripheral wall of the housing or a cavity formed in a water jacket disposed inside or outside the housing.

The motor main body includes a rotatable rotor including an output shaft axially supported by the housing, and a stator that generates a force for rotating the rotor. The output shaft of the driving motor 24 (6*a*) directly or indirectly transmits a rotational force to the driving wheel 21. That is, the output shaft of the driving motor 24 (6*a*) is coupled to the driving wheel 21 or is operatively coupled to the driving wheel 21 via a drive transmission mechanism such as a speed reducer. Thus, the driving wheel 21 rotates by drive of the driving motor 24 (6*a*).

Returning to FIG. 1, the crawler belt 23 is wound around the idlers 20, the driving wheel 21, and the rollers 22. The inner periphery of the crawler belt 23 is engaged with the outer periphery (engagement teeth) of the driving wheel 21. Thus, as the driving wheel 21 rotates by receiving the drive of the driving motor 24 (6*a*), a rotational torque of the driving wheel 21 is transmitted to the crawler belt 23 via the engagement teeth correspondingly. That is, the crawler belt 23 rotates around the pair of idlers 20, the plurality of rollers 22, and the driving wheel 21.

Figure 3:
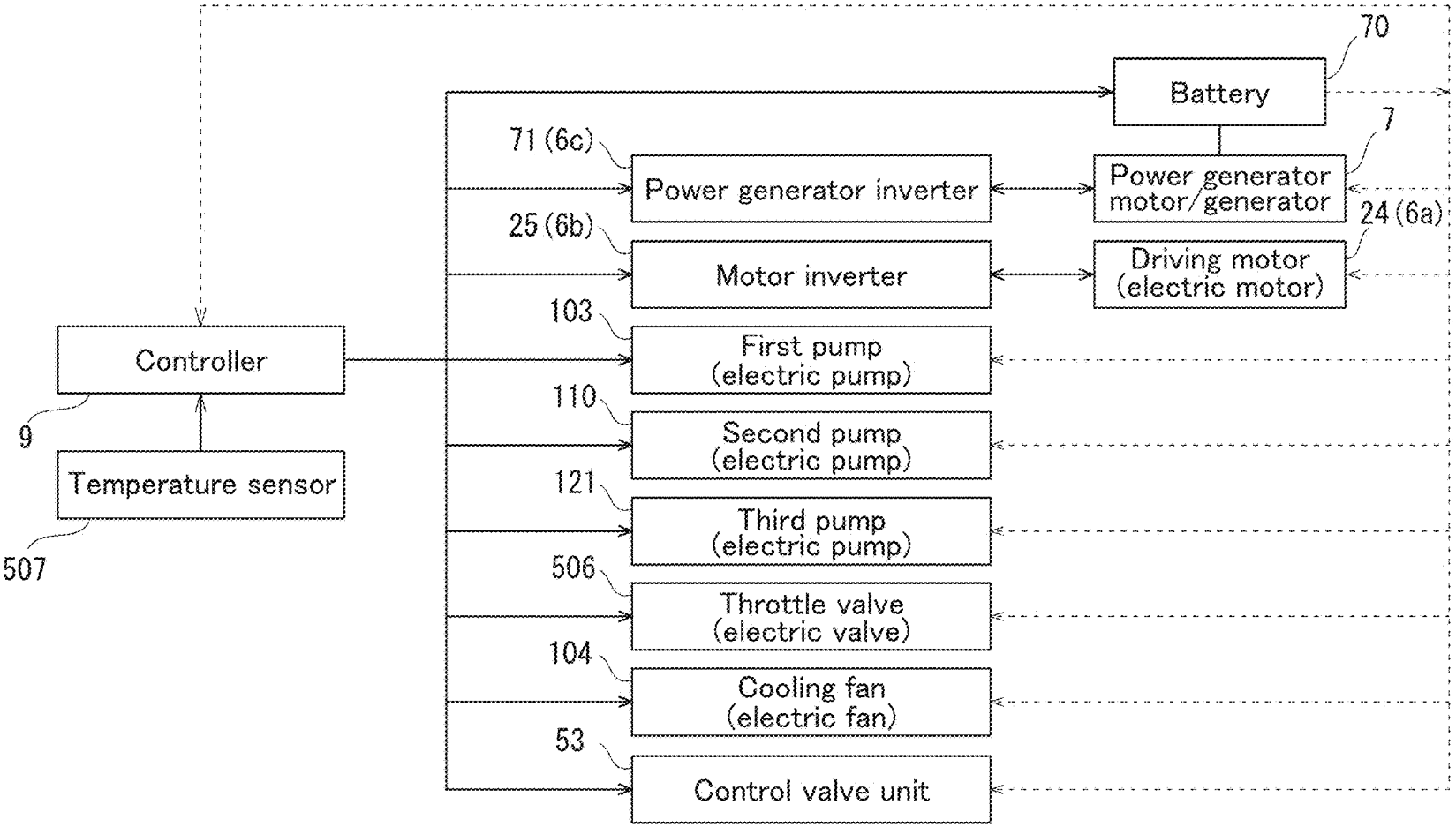
FIG. 3 is a schematic block diagram of an electric system of the working machine according to an example embodiment of the present invention.

As described above, the driving motor 24 is an electric motor that is the electric device 6*a*. Accordingly, as illustrated in FIGS. 2 and 3, the working machine 1 includes an inverter (hereinafter referred to as a motor inverter) 25 that is the electric device 6*b*. The motor inverter 25 (6*b*) performs rotational control on the driving motor 24.

In the present example embodiment, the motor inverter 25 (6*b*) is a liquid-cooled inverter. Specifically, the motor inverter 25 (6*b*) includes electric components such as a power module (Insulated Gate Bipolar Transistor (IGBT), Intelligent Power Module (IPM), Metal-Oxide-Semiconductor Field-Effect Transistor (MOSFET)), an electrolytic capacitor, a reactor, and the like, and a heat sink that cools these electric components. The heat sink is a liquid-cooled heat sink, and includes an internal passage through which the first cooling medium A flows as illustrated in FIG. 2. The internal passage includes a start end (IN) serving as an inlet for the first cooling medium A and a terminal end (OUT) serving as an outlet for the first cooling medium A. The inlet (IN) and the outlet (OUT) are configured to be connectable to a pipe defining the passage through which the first cooling medium A flows.

Returning to FIG. 1, the working machine 1 according to the present example embodiment is a ride-on working machine. Accordingly, a cabin 30 is mounted on the machine body 3. Note that, in addition to an operator's seat DS on which an operator is seated, a steering wheel for steering, an operation unit for performing various operations, and the like are provided in the cabin 30.

The working device 4 includes at least one boom 40 coupled to the machine body 3, and a working tool (attachment) 41 coupled to the boom 40 and having a predetermined function.

In the present example embodiment, the working machine 1 is a track loader (compact track loader). That is, the working device 4 is a loader device that performs loading work as the predetermined work.

The at least one boom 40 includes a pair of booms 40 provided at an interval in the width direction. That is, the pair of booms 40 are coupled to the machine body 3 at an interval in the width direction. Specifically, one of the pair of booms 40 is disposed leftward of the machine body 3. In contrast, another of the pair of booms 40 is disposed rightward of the machine body 3. Each of the pair of booms 40 has a proximal end portion and a distal end portion opposite to the proximal end portion. The proximal end portion of each of the pair of booms 40 is coupled to the machine body 3 via a shaft extending in the width direction. Thus, the pair of booms 40 can swing (rotate) about the shaft (proximal end portions). The pair of booms 40 are coupled to each other by a coupling body between the proximal end portions and a coupling body between the distal end portions.

The working tool 41 is a bucket. The working tool (bucket) 41 is coupled to the respective distal end portions of the pair of booms 40 so as to be rotatable about an axis extending in the width direction.

As described above, the working machine 1 includes the actuators 50*a* and 50*b* that actuate the working device (loader device) 4. The actuators of the working machine 1 according to the present example embodiment include at least one raising/lowering cylinder 50*a* (in the present example embodiment, a pair of raising/lowering cylinders 50*a* as illustrated in FIG. 2) that raises/lowers the pair of booms 40 and at least one swinging cylinder 50*b* (in the present example embodiment, a pair of swinging cylinders 50*b* as illustrated in FIG. 2) that swings the working tool (bucket) 41.

Each of the raising/lowering cylinder 50*a* and the swinging cylinder 50*b* is a hydraulic cylinder that extends/contracts by supply/recovery of a hydraulic fluid. The hydraulic cylinders 50*a* and 50*b* each extend in one direction and each have one end portion and another end portion opposite to the one end portion in the one direction. Specifically, the hydraulic cylinders 50*a* and 50*b* each include a tube-shaped cylinder main body extending in the one direction and having a proximal end and a distal end in the one direction, and a piston rod including a piston at one end portion. The piston is mounted in the cylinder main body so as to be movable in the one direction. A portion of the piston rod near another end portion of the piston rod protrudes from the distal end of the cylinder main body. Thus, in each of the hydraulic cylinders 50*a* and 50*b*, a proximal end portion of the cylinder main body serves as the one end portion of the hydraulic cylinder, and the other end portion of the piston rod serves as the other end portion of the hydraulic cylinder.

The at least one raising/lowering cylinder (hydraulic cylinder) 50*a* (e.g., the pair of raising/lowering cylinders 50*a*) is coupled at the one end portion thereof (the proximal end portion of the cylinder main body) to the machine body 3 so as to be rotatable about an axis extending in the width direction, and is coupled at the other end portion thereof (the other end portion of the piston rod) to the booms 40 so as to be rotatable about an axis extending in the width direction. Thus, when the at least one raising/lowering cylinder 50*a* extends/contracts in the one direction, the pair of booms 40 rotate about the proximal end portions thereof, and the distal end portions of the pair of booms 40 are raised/lowered.

The at least one swinging cylinder (hydraulic cylinder) 50*b* (e.g., the pair of raising/lowering cylinders 50*a*) is coupled at the one end portion thereof (the proximal end portion of the cylinder main body) to the booms 40 so as to be rotatable about an axis extending in the width direction, and is coupled at the other end portion thereof (the other end portion of the piston rod) to the working tool (bucket) 41 so as to be rotatable about an axis extending in the width direction. Thus, when the at least one swinging cylinder 50*b* extends/contracts in the one direction, the bucket 41 rotates about the distal end portions of the booms 40 to change its posture. That is, the bucket 41 performs shoveling and dumping by swinging.

The working machine 1 of the present example embodiment is configured such that the working tool 41 can be exchanged from the bucket to another working tool, and configured to perform various types of work other than excavation work and loading work (or another excavation work). That is, the bucket 41 is attachable/detachable to/from the distal end portions of the booms 40, and a working tool 41 other than the bucket 41 is also attachable/detachable to/from the distal end portions of the booms 40. In the present example embodiment, the bucket 41 can be detached from the working machine 1, and a hydraulic attachment as another working tool 41 can be attached to the distal end portions of the booms 40. The hydraulic attachment means a hydraulically driven working tool (attachment) 41 including a hydraulic actuator 50*c* (see FIG. 2) such as a hydraulic motor or a hydraulic cylinder. Examples of the hydraulic attachment include a hydraulic crusher, a hydraulic breaker, an angle broom, an earth auger, a pallet fork, a sweeper, a mower, a snow blower, and the like.

In the present example embodiment, a diesel engine is used as the internal combustion engine 8. The internal combustion engine 8 is a water-cooled engine, and includes therein a passage through which a third cooling medium C flows as illustrated in FIG. 2. Accordingly, the passage of the internal combustion engine 8 includes an inlet (IN) to which the third cooling medium C flows in and an outlet (OUT) from which the third cooling medium C flows out. The internal combustion engine 8 is supported by the machine body 3 via a vibration isolation mechanism. In the present example embodiment, the internal combustion engine 8 is disposed in a rear portion of the machine body 3 (see FIG. 1).

The power generator 7 generates electric power by receiving drive from the internal combustion engine 8. Accordingly, as illustrated in FIG. 3, the working machine 1 includes a battery 70 that stores the electric power generated by the power generator 7 and supplies the stored electric power to the electric devices 6*a*, 6*b*, and 6*c* and the like. Note that the battery 70 is connected to a plurality of electric devices (including a first pump 103, a second pump 110, a third pump 121, a throttle valve 506, a cooling fan 104, a control valve unit 53, and the like, which will be described later, in addition to the driving motor 24 (6*a*), the motor inverter 25 (6*b*), and a power generator inverter 71 (6*c*)) mounted on the working machine 1, and supplies the electric power also to these electric devices.

In the present example embodiment, the power generator 7 also functions as an electric motor that drives the hydraulic pump 51. That is, the power generator 7 according to the present example embodiment is a motor generator having a function as an electric motor that drives the hydraulic pump 51 by receiving supply of the electric power from the battery 70, and a function as the power generator 7 (generator).

In the present example embodiment, the power generator (motor generator) 7 is a three-phase AC synchronous motor including one or more permanent magnets. The power generator (motor generator) 7 includes a housing fixed to the internal combustion engine 8 and a motor main body housed in the housing. The motor main body includes a rotatable rotor and a stator that generates a force for rotating the rotor.

The power generator (motor generator) 7 is supported by the machine body 3 via a vibration isolation mechanism. In the present example embodiment, the power generator (motor generator) 7 is fixed to a front portion of the internal combustion engine 8 (see FIG. 1). The power generator (motor generator) 7 is a liquid-cooled power generator, and includes a passage through which the second cooling medium B flows as illustrated in FIG. 2. The passage includes a start end (IN) serving as an inlet for the second cooling medium B and a terminal end (OUT) serving as an outlet for the second cooling medium B. The inlet (IN) and the outlet (OUT) are configured to be connectable to a pipe defining the passage through which the second cooling medium B flows. Note that the passage of the power generator (motor generator) 7 includes a cavity formed in a peripheral wall of the housing or a cavity formed in a water jacket disposed inside or outside the housing, similarly to the driving motor 24 (6*a*).

In the present example embodiment, the power generator 7 is the motor generator. Hence, as illustrated in FIGS. 2 and 3, the working machine 1 includes the power generator inverter 71 that is the electric device 6*c*.

In the present example embodiment, the power generator inverter 71 (6*c*) is a liquid-cooled inverter. Specifically, similarly to the motor inverter 25 (6*b*), the power generator inverter 71 (6*c*) includes electric components such as a power module (IGBT, IPM, MOSFET), an electrolytic capacitor, a reactor, and the like, and a heat sink that cools these electric components. The heat sink is a liquid-cooled heat sink, and includes an internal passage through which the first cooling medium A flows as illustrated in FIG. 2. The internal passage includes a start end (IN) serving as an inlet for the first cooling medium A and a terminal end (OUT) serving as an outlet for the first cooling medium A. The inlet (IN) and the outlet (OUT) are configured to be connectable to a pipe defining the passage through which the first cooling medium A flows.

As described above, in the present example embodiment, the working machine 1 includes the driving motor 24 (6*a*), the motor inverter 25 (6*b*), and the power generator inverter 71 (6*c*) as the electric devices, each of which is a liquid-cooled electric device. Note that, as illustrated in FIG. 3, the working machine 1 includes a controller 9 that performs control relating to the entire working machine 1, and the electric devices 6*a*, 6*b*, and 6*c* are actuated based on instructions from the controller 9. Note that the controller 9 is also connected to electric devices (electric devices such as the first pump 103, the second pump 110, the third pump 121, the throttle valve 506, the cooling fan 104, and the control valve unit 53) other than the driving motor 24 (6*a*), the motor inverter 25 (6*b*), and the power generator inverter 71 (6*c*), and also controls these electric devices.

The hydraulic system 5 includes the hydraulic pump 51 as described above. Additionally, as illustrated in FIG. 2, the hydraulic system 5 includes a hydraulic fluid tank 52 that stores a hydraulic fluid S, a primary system 5A that connects the actuators 50*a* and 50*b* and the hydraulic fluid tank 52 via the hydraulic pump 51 and supplies the hydraulic fluid S stored in the hydraulic fluid tank 52 to the actuators 50*a* and 50*b* by drive of the hydraulic pump 51, and a secondary system 5B that connects the actuators 50*a* and 50*b* and the hydraulic fluid tank 52 and returns the hydraulic fluid S from the actuators 50*a* and 50*b* to the hydraulic fluid tank 52. Additionally, the hydraulic system 5 includes the control valve unit 53 that controls the flow of the hydraulic fluid S.

The power of the internal combustion engine 8 and the power of the power generator (motor generator) 7 are transmitted to the hydraulic pump 51 selectively or in combination. That is, the hydraulic pump 51 is driven by at least one of the internal combustion engine 8 and the power generator (motor generator) 7.

In the present example embodiment, the hydraulic pump 51 is a multiple hydraulic pump. Specifically, the hydraulic pump 51 is a multiple hydraulic pump including a main pump, a sub pump, and a pilot pump, which are disposed in series. Note that FIG. 2 illustrates a system connected to the main pump, as the hydraulic system 5.

The main pump includes a fixed displacement gear pump or a variable displacement hydraulic pump 51. The hydraulic fluid S delivered from the main pump is supplied to the actuators 50*a* and 50*b* to actuate the actuators 50*a* and 50*b*. Specifically, hydraulic actuators that are actuated by the main pump include the actuator 50*c* of the hydraulic attachment that is attached instead of the bucket 41, in addition to the raising/lowering cylinder 50*a* and the swinging cylinder 50*b*.

The sub pump is a hydraulic pump to increase the amount of the hydraulic fluid S to be supplied to the actuators 50*a* and 50*b* that are actuated by the main pump. The pilot pump is a hydraulic pump to supply the hydraulic fluid S for pilot signals to control valves that control the actuators 50*a* and 50*b* that are actuated by the main pump. The sub pump and the pilot pump include, for example, fixed displacement gear pumps.

The hydraulic fluid tank 52 is provided with a temperature sensor 507 that measures the temperature of the stored hydraulic fluid S as illustrated in FIG. 3, in addition to a level indicator that measures the level (fluid amount) of the stored hydraulic fluid S. The temperature sensor 507 transmits a signal relating to an actual temperature of the hydraulic fluid S (the hydraulic fluid S returned from the actuators 50*a*, 50*b*, and 50*c*) stored in the hydraulic fluid tank 52 to the controller 9.

Returning to FIG. 2, the primary system 5A is a system that connects the hydraulic fluid tank 52 and the actuators 50*a* and 50*b*, and is a system that supplies the hydraulic fluid in the hydraulic fluid tank 52 to the actuators 50*a* and 50*b*. Specifically, the primary system 5A includes a first supply fluid passage 500 that connects a suction port (a port to suck the hydraulic fluid S) of the hydraulic pump 51 (main pump) and the hydraulic fluid tank 52, a second supply fluid passage 501 that connects a delivery port (a port to deliver the hydraulic fluid S) of the hydraulic pump 51 (main pump) and the control valve unit 53, and a third supply fluid passage 502 that connects the control valve unit 53 and the actuators 50*a* and 50*b*. Thus, the hydraulic pump 51 (main pump) sucks the hydraulic fluid S in the hydraulic fluid tank 52 and delivers the hydraulic fluid S toward the control valve unit 53 and the actuators 50*a* and 50*b*.

The secondary system 5B is a system that connects the actuators 50*a* and 50*b* and the hydraulic fluid tank 52, and is a system that returns the hydraulic fluid S supplied to the actuators 50*a* and 50*b*, to the hydraulic fluid tank 52. Specifically, the secondary system 5B includes a first return fluid passage 503 that connects the actuators 50*a* and 50*b* and the control valve unit 53 and returns the hydraulic fluid S of the actuators 50*a* and 50*b* to the control valve unit 53, and a second return fluid passage 504 that connects the control valve unit 53 and the hydraulic fluid tank 52 and returns the hydraulic fluid S returned from the actuators 50*a* and 50*b* to the control valve unit 53, to the hydraulic fluid tank 52.

The first supply fluid passage 500, the second supply fluid passage 501, the third supply fluid passage 502, the first return fluid passage 503, and the second return fluid passage 504 include pipes. A first heat exchanger 100*a* of the first cooling system 10, which will be described later, is interposed in the secondary system 5B. In the present example embodiment, the first heat exchanger 100*a* is interposed in the second return fluid passage 504 of the secondary system 5B. Although details will be described later, a passage through which the hydraulic fluid S flows and that defines a portion of the second return fluid passage 504 is formed in the first heat exchanger 100*a*.

In the present example embodiment, the hydraulic system 5 (secondary system 5B) includes a bypass 505 that connects a first position P1 located upstream of the first heat exchanger 100*a* on the second return fluid passage 504 and a second position P2 located downstream of the first heat exchanger 100*a*. The bypass 505 includes the throttle valve 506 that adjusts the flow rate of the hydraulic fluid S.

The control valve unit 53 includes a plurality of control valves 53*a*, 53*b*, and 53*c*. The control valve unit 53 illustrated in FIG. 2 includes three control valves 53*a*, 53*b*, and 53*c*. Note that, in the following description, the three control valves 53*a*, 53*b*, and 53*c* are referred to as a first control valve 53*a*, a second control valve 53*b*, and a third control valve 53*c*.

The first control valve 53*a* is a valve that controls the raising/lowering cylinder (hydraulic actuator) 50*a*. The second control valve 53*b* is a control valve that controls the swinging cylinder (hydraulic actuator) 50*b*. The third control valve 53*c* is a valve that controls the actuator 50*c* provided in a hydraulic attachment. The hydraulic attachment is a hydraulically driven working tool 41. The actuator 50*c* of the hydraulic attachment is connected to the third control valve 53*c* via a connecting member 54.

The control valve unit 53 includes two passages of the third supply fluid passage 502 and the first return fluid passage 503 as the passages connected to each of the actuators 50*a*, 50*b*, and 50*c*. The supply passage and the return passage are switched by actuation of each of the actuators 50*a* and 50*b* (control of each of the control valves 53*a*, 53*b*, and 53*c* (first control valve 53*a*, second control valve 53*b*, and third control valve 53*c*)). That is, as the third supply fluid passage 502 that has been a supply passage turns into the first return fluid passage 503, the first return fluid passage 503 that has been a return passage turns into the third supply fluid passage 502 correspondingly.

The working machine 1 includes the driving motor (electric motor) 24 (6*a*), the power generator 7, the internal combustion engine 8, and the hydraulic system 5 as components (heat sources) that generate heat with drive (load), and hence, includes a cooler system to cool these components.

The working machine 1 (cooler system) includes a circulation passage through which a medium circulates, the medium which is to exchange heat with a heat source and to take heat of the heat source through heat exchange. Specifically, as described above, the working machine 1 (cooler system) includes the first cooling system 10 that causes the first cooling medium A to circulate therethrough to cool the electric devices 6*a*, 6*b*, and 6*c*, and the second cooling system 11 that causes the second cooling medium B to circulate therethrough to cool the power generator 7. Additionally, the working machine 1 (cooler system) includes the internal combustion engine 8, and hence, includes a third cooling system 12 that causes the third cooling medium C to circulate therethrough to cool the internal combustion engine 8.

The first cooling system 10 includes the first heat exchanger 100*a* that exchanges heat between the hydraulic fluid S flowing through the hydraulic system 5 and the first cooling medium A to cool the hydraulic fluid S, a second heat exchanger 100*b* that exchanges heat between the first cooling medium A and the second cooling medium B to cool the second cooling medium B, and a third heat exchanger 100*c* that exchanges heat between the first cooling medium A and outside air to cool the first cooling medium A so that a temperature of the first cooling medium A becomes lower than temperatures before the heat exchange of the hydraulic fluid S and the second cooling medium B. Further, in the present example embodiment, the first cooling system 10 includes a cooling medium tank 102 that stores the first cooling medium A, and the pump (hereinafter, referred to as a first pump) 103 that sucks and delivers the first cooling medium A in the cooling medium tank 102.

Figure 4:
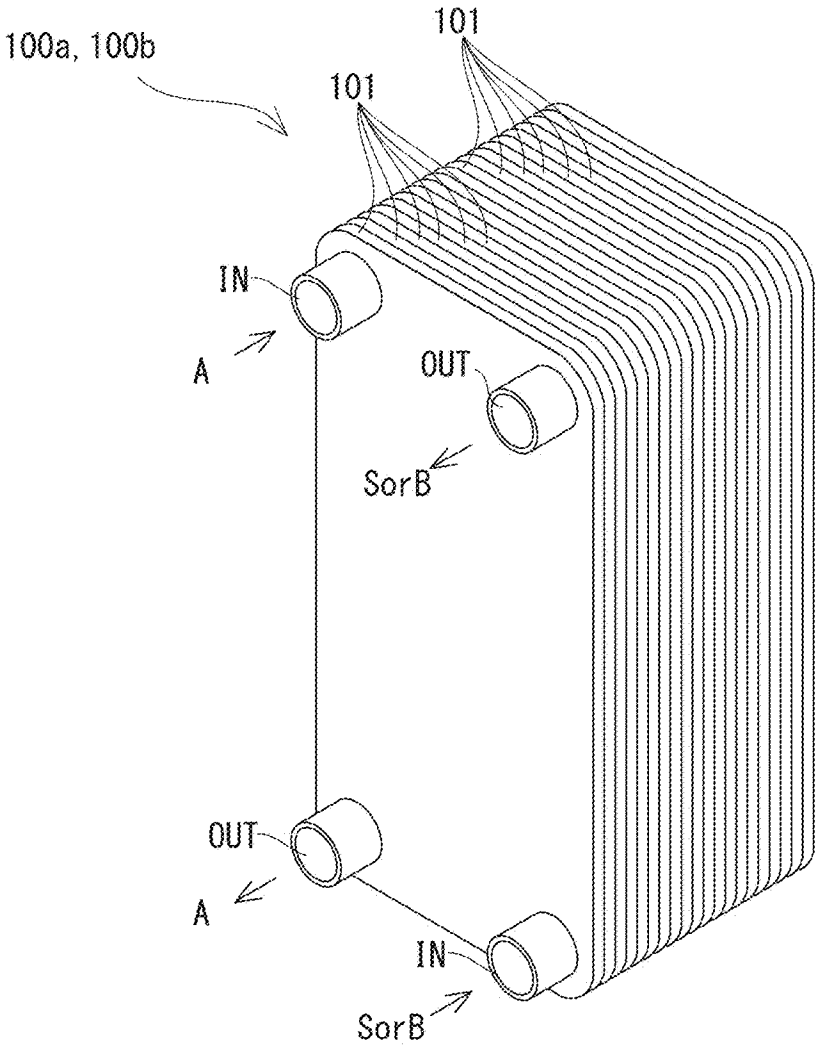
FIG. 4 is a perspective view of a plate-shaped heat exchanger that is used as each of a first heat exchanger and a second heat exchanger of the first cooling system of the working machine according to an example embodiment of the present invention.
Figure 5:
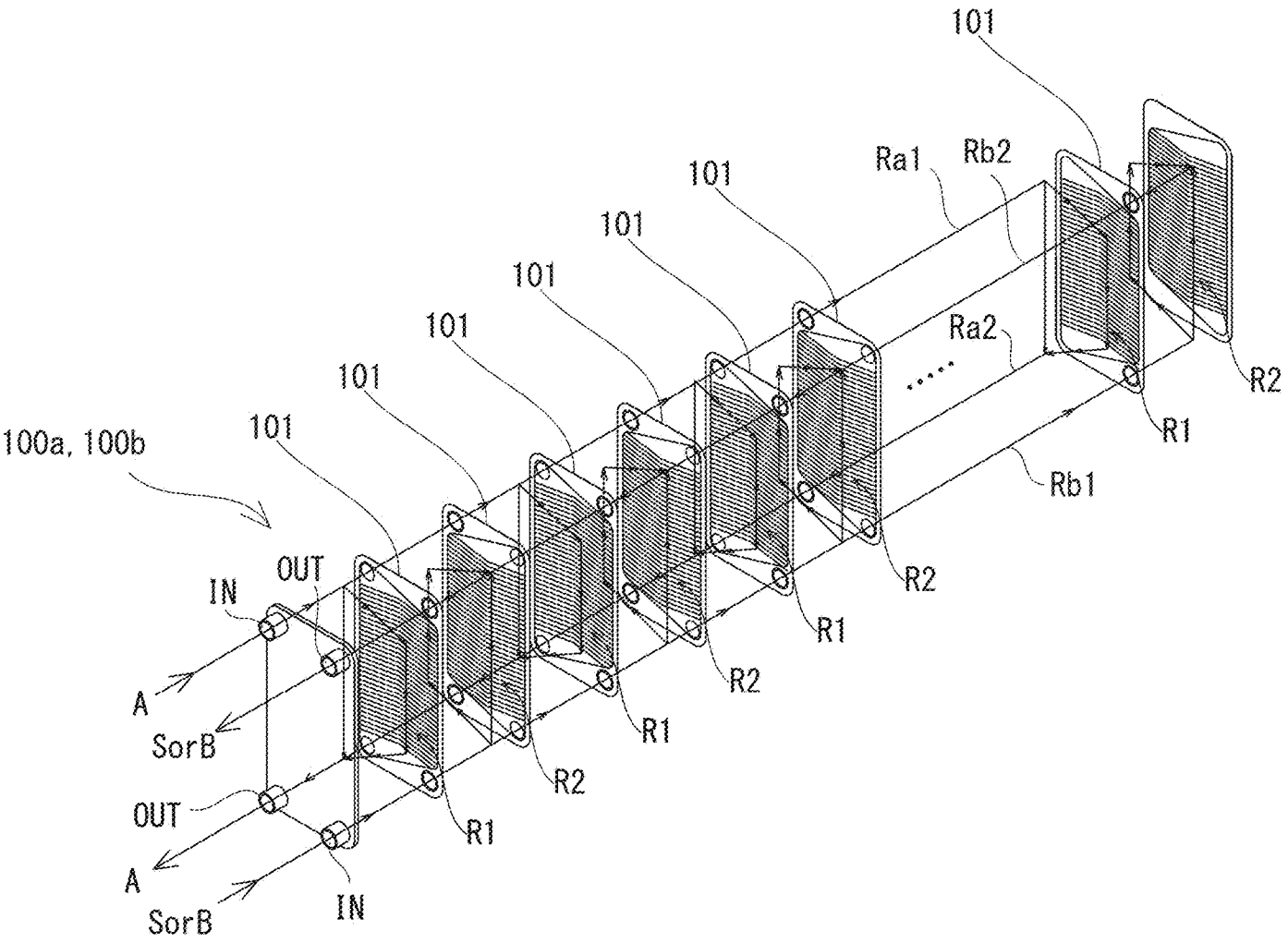
FIG. 5 is a schematic exploded perspective view of the plate-shaped heat exchanger illustrated in FIG. 4.

The first heat exchanger 100*a* and the second heat exchanger 100*b* are liquid-cooled heat exchangers. In the present example embodiment, as illustrated in FIGS. 4 and 5, plate-shaped heat exchangers are used as the liquid-cooled heat exchangers. The plate-shaped heat exchangers 100*a* and 100*b* each include a plurality of heat transfer plates 101. As illustrated in FIG. 5, the plurality of heat transfer plates 101 are stacked in a state of facing each other, and a first passage R1 through which a heat exchanging medium A flows and a second passage R2 through which a heat exchanged medium B or S flows are alternately formed with each of the heat transfer plates 101 as a boundary.

Specifically, each of the plurality of heat transfer plates 101 is formed by press-molding a metal plate, and a plurality of concave threads and convex threads are formed on a front surface and a back surface. On each of the front surface and the back surface, the concave threads and the convex threads are alternately arranged in a direction orthogonal to a direction in which the concave threads (convex threads) extend. As described above, the heat transfer plate 101 is formed by press-molding a metal plate. Hence, the concave threads on the front surface define the convex threads on the back surface, and the convex threads on the front surface define the concave threads on the back surface. The convex threads of each of the plurality of stacked heat transfer plates 101 meet the convex threads of the adjacent heat transfer plates 101 in a crossing manner. Thus, the concave threads of the adjacent heat transfer plates 101 define the first passage R1 or the second passage R2.

Each of the plurality of heat transfer plates 101 has openings at four corners. In a state in which the plurality of heat transfer plates 101 are stacked, each of the four openings of the heat transfer plates 101 is continuous in a stacking direction of the heat transfer plates 101, and forms a passage that communicates with the first passage R1 or the second passage R2.

Specifically, two openings of the four openings define two passages Ra1 and Ra2 connected to the first passage R1, and the remaining two openings define two passages Rb1 and Rb2 connected to the second passage R2. One passage Ra1 of the two passages Ra1 and Ra2 connected to the first passage R1 is an inflow passage through which the heat exchanging medium A flows in, and another passage Ra2 is an outflow passage through which the heat exchanging medium A, which has passed through the first passage R1, flows out.

Accordingly, one end opening of the inflow passage Ra1 (an opening of the outermost heat transfer plate 101) defines an inlet (IN) to which the heat exchanging medium A flows in, and one end opening of the outflow passage Ra2 (an opening of the outermost heat transfer plate 101) defines an outlet (OUT) from which the heat exchanging medium A flows out.

Also, one passage Rb1 of the two passages Rb1 and Rb2 connected to the second passage R2 is an inflow passage through which the heat exchanged medium S or B flows in, and another passage Rb2 is an outflow passage through which the heat exchanged medium S or B, which has passed through the second passage R2, flows out. Accordingly, one end opening of the inflow passage Rb1 (an opening of the outermost heat transfer plate 101) defines an inlet (IN) to which the heat exchanged medium S or B flows in, and one end opening of the outflow passage Rb2 (an opening of the outermost heat transfer plate 101) defines an outlet (OUT) from which the heat exchanged medium S or B flows out.

Returning to FIG. 2, in the first heat exchanger 100*a*, the first cooling medium A is caused to flow through the first passage R1 as the heat exchanging medium, and the hydraulic fluid S is caused to flow through the second passage R2 as the heat exchanged medium.

In contrast, in the second heat exchanger 100*b*, the first cooling medium A is caused to flow through the first passage R1 as the heat exchanging medium, and the second cooling medium B is caused to flow through the second passage R2 as the heat exchanged medium.

The third cooling system 12 includes a fourth heat exchanger 120 that exchanges heat between the third cooling medium C and outside air and is provided in parallel with the third heat exchanger 100*c*. Accordingly, at least one of the first cooling system 10 and the third cooling system 12 includes the cooling fan 104 that is arranged beside the third heat exchanger 100*c* and the fourth heat exchanger 120. That is, at least one of the first cooling system 10 and the third cooling system 12 includes the cooling fan 104 that sends outside air toward the third heat exchanger 100*c* and the fourth heat exchanger 120.

Figure 6:
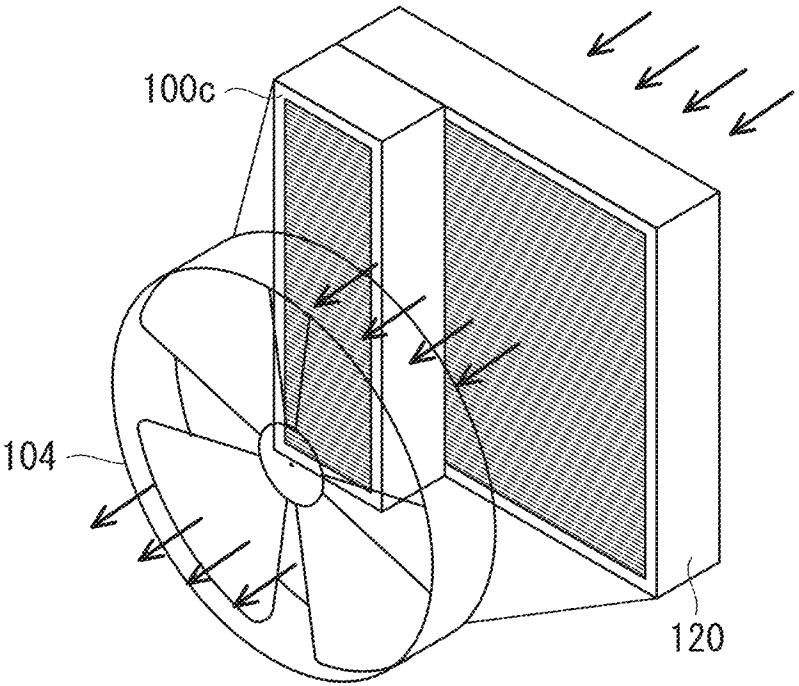
FIG. 6 is a schematic perspective view for explaining arrangement of a third heat exchanger, a fourth heat exchanger, and a cooling fan of the working machine according to an example embodiment of the present invention.

As illustrated in FIG. 6, each of the third heat exchanger 100*c* and the fourth heat exchanger 120 is a so-called radiator, and includes a pipe body that defines a passage through which the cooling medium (first cooling medium A, third cooling medium C) flows, and a plurality of fins disposed in the periphery of the pipe body.

In each of the third heat exchanger 100*c* and the fourth heat exchanger 120, the pipe body defines the passage as a pipeline. The pipe body (passage) includes a start end and a terminal end, the start end defines an inlet to which the cooling medium (first cooling medium A, third cooling medium C) flows in, and the terminal end defines an outlet from which the cooling medium (first cooling medium A, third cooling medium C) flows out. The inlet and the outlet are connected to a pipe that defines the passage. The lengths of the passages (pipe bodies) of the radiators 100*c* and 120 are set in accordance with heat exchange capacities.

In general, in the radiators 100*c* and 120, the passages (pipe bodies) are disposed in a meandering manner in order to provide the passages (pipe bodies) having necessary lengths in a predetermined space. That is, the passages (pipe bodies) of the radiators 100*c* and 120 each have a plurality of straight portions disposed in a straight-line shape and a U-shaped turn portion that connects the adjacent straight portions to each other. The straight portions and the turn portion are alternately connected to define the passage having the necessary length.

The pipe bodies (straight portions) are arranged so as to penetrate a plurality of fins arranged in a direction in which the straight portions extend. The plurality of fins are disposed at intervals in a predetermined direction (the direction in which the straight portions extend). Thus, a gap (air passage) through which outside air passes in a direction orthogonal to the predetermined direction is formed between the adjacent fins. Note that FIG. 6 illustrates only fins appearing on an outer surface (appearance).

In the present example embodiment, based on the premise of the above-described configuration, the third heat exchanger 100*c* and the fourth heat exchanger 120 are disposed to overlap each other such that the air passages (gaps between the fins) of the third heat exchanger 100*c* and the fourth heat exchanger 120 are continuous in the same direction.

The cooling fan 104 is an electric fan that is driven by an electric motor M, and is provided in the first cooling system 10 in the present example embodiment (see FIG. 2). Examples of the cooling fan 104 include a push-in fan that pushes outside air and a suction fan that sucks outside air.

In the present example embodiment, a suction fan is used as the cooling fan 104, and the cooling fan 104 is disposed inward of the third heat exchanger 100*c* and the fourth heat exchanger 120 in the machine body 3 in a state in which a suction direction of outside air coincides with airflow directions of the third heat exchanger 100*c* and the fourth heat exchanger 120. Thus, the cooling fan 104 sucks outside air and sends the outside air toward the third heat exchanger 100*c* and the fourth heat exchanger 120 provided in parallel (sends outside air outside the machine body 3 toward the third heat exchanger 100*c* and the fourth heat exchanger 120).

Thus, the sent outside air passes through the third heat exchanger 100*c* and the fourth heat exchanger 120 (between the fins), and each of the first cooling medium A and the third cooling medium C exchanges heat with the outside air and is cooled.

Returning to FIG. 2, the first pump 103 is an electric pump, and has a suction port to suck the first cooling medium A, and a delivery port to deliver the first cooling medium A sucked into the suction port. Accordingly, the first cooling system 10 includes a suction-side pipe 105 that connects the cooling medium tank 102 and the suction port of the first pump 103 and through which the first cooling medium A flows from the cooling medium tank 102 to the first pump 103 (through which the first cooling medium A is sucked), and a delivery-side pipe 106 that connects the delivery port of the first pump 103 and the cooling medium tank 102 and through which the first cooling medium A delivered by the first pump 103 flows and the first cooling medium A returns to the cooling medium tank 102.

As described above, the first cooling system 10 includes the first heat exchanger 100*a*, the second heat exchanger 100*b*, and the third heat exchanger 100*c*. Specifically, the first heat exchanger 100*a*, the second heat exchanger 100*b*, and the third heat exchanger 100*c* are disposed on the delivery-side pipe 106 of the first cooling system 10. In the present example embodiment, the third heat exchanger 100*c*, the second heat exchanger 100*b*, and the first heat exchanger 100*a* are disposed in this order from an upstream side to a downstream side of the delivery-side pipe 106. That is, the third heat exchanger 100*c* is disposed most upstream in a flow direction of the first cooling medium A, the first heat exchanger 100*a* is disposed most downstream in the flow direction of the first cooling medium A, and the second heat exchanger 100*b* is disposed between the first heat exchanger 100*a* and the third heat exchanger 100*c*.

Accordingly, the delivery-side pipe 106 includes a first delivery-side pipe 106*a* that connects the delivery port of the first pump 103 and an inlet (IN) for the first cooling medium (heat exchanging medium) A of the third heat exchanger 100*c*, a second delivery-side pipe 106*b* that connects an outlet (OUT) for the first cooling medium (heat exchanging medium) A of the third heat exchanger 100*c* and an inlet (IN) for the first cooling medium (heat exchanging medium) A of the second heat exchanger 100*b*, a third delivery-side pipe 106*c* that connects an outlet (OUT) for the first cooling medium (heat exchanging medium) A of the second heat exchanger 100*b* and an inlet (IN) for the first cooling medium (heat exchanging medium) A of the first heat exchanger 100*a*, and a fourth delivery-side pipe 106*d* that connects an outlet (OUT) for the first cooling medium (heat exchanging medium) A of the first heat exchanger 100*a* and the cooling medium tank 102.

An inlet (IN) for the heat exchanged medium (hydraulic fluid S) of the first heat exchanger 100*a* is connected to the control valve unit 53 (upstream) side of the second return fluid passage 504, and an outlet (OUT) for the heat exchanged medium (hydraulic fluid S) of the first heat exchanger 100*a* is connected to the hydraulic fluid tank 52 (downstream) side of the second return fluid passage 504. Thus, a passage (inflow passage Rb1, second passage R2, outflow passage Rb2: see FIG. 5) through which the hydraulic fluid (heat exchanged medium) S flows of the first heat exchanger 100*a* defines a portion of the second return fluid passage 504.

Further, the plurality of electric devices 6*a*, 6*b*, and 6*c* (liquid-cooled electric devices 6*a*, 6*b*, and 6*c*) are included in the first cooling system 10. In the present example embodiment, the plurality of electric devices 6*a*, 6*b*, and 6*c* are disposed on the delivery-side pipe 106 of the first cooling system 10. More specifically, the plurality of electric devices 6*a*, 6*b*, and 6*c* are disposed on the second delivery-side pipe 106*b* of the delivery-side pipe 106.

The plurality of electric devices 6*a*, 6*b*, and 6*c* are disposed in ascending order of heat resistance and heat generation temperature during operation from the upstream side to the downstream side in the flow direction of the first cooling medium A. In the present example embodiment, the power generator inverter 71 (6*c*), the motor inverter 25 (6*b*), and the driving motor 24 (6*a*) are disposed in this order from the upstream side to the downstream side of the first cooling system 10.

That is, in the first cooling system 10, the inverters 71 (6*c*) and 25 (6*b*) have lower heat resistances than the heat resistance of another electric device 6*a* (in the present example embodiment, the driving motor 24 (6*a*)). Hence, the inverters 71 (6*c*) and 25 (6*b*) are located upstream of the other electric device 6*a*. In the present example embodiment, the power generator inverter 71 (6*c*) has specifications with a lower heat resistance than the heat resistance of the motor inverter 25 (6*b*). Hence, the power generator inverter 71 (6*c*) is located upstream of the motor inverter 25 (6*b*).

Accordingly, the second delivery-side pipe 106*b* includes a first connection pipe 107*a* that connects the outlet (OUT) for the first cooling medium (heat exchanging medium) A of the third heat exchanger 100*c* and the inlet (IN) of the power generator inverter 71 (6*c*), a second connection pipe 107*b* that connects the outlet (OUT) of the power generator inverter 71 (6*c*) and the inlet (IN) of the motor inverter 25 (6*b*), a third connection pipe 107*c* that connects the outlet (OUT) of the motor inverter 25 (6*b*) and the inlet (IN) of the driving motor 24 (6*a*), and a fourth connection pipe 107*d* that connects the outlet (OUT) of the driving motor 24 (6*a*) and the inlet (IN) for the first cooling medium (heat exchanging medium) A of the second heat exchanger 100*b*.

The second cooling system 11 includes an annular passage (circulation passage) through which the second cooling medium B flows. The pump (hereinafter, referred to as a second pump) 110 to deliver (pumping) the second cooling medium B, the second heat exchanger 100*b*, and the power generator 7 are disposed on the circulation passage of the second cooling system 11. The second pump 110 is an electric pump, and has a suction port to suck the second cooling medium B and a delivery port to deliver the second cooling medium B.

To provide the circulation passage, the second cooling system 11 includes a first pipe 111*a* that connects the delivery port of the second pump 110 and an inlet (IN) for the second cooling medium (heat exchanged medium) B of the second heat exchanger 100*b*, a second pipe 111*b* that connects an outlet (OUT) for the second cooling medium (heat exchanged medium) B of the second heat exchanger 100*b* and the inlet (IN) of the power generator 7, and a third pipe 111*c* that connects the outlet (OUT) of the power generator 7 and the suction port of the second pump 110. Thus, the second cooling system 11 uses the second passage R2 of the second heat exchanger 100*b* and the internal passage of the power generator 7 as a portion of the circulation passage, and causes the second cooling medium B to circulate therethrough while causing the second cooling medium B to pass through the second heat exchanger 100*b* and the power generator 7 by the second pump 110 being driven.

In the present example embodiment, the second cooling medium B is a liquid having a specific heat smaller than the specific heat of the first cooling medium A and a boiling point higher than the boiling point of the first cooling medium A. Specifically, the first cooling medium (heat exchanging medium) A flowing through the first cooling system 10 is water. In contrast, the second cooling medium (heat exchanged media) B flowing through the second cooling system 11 is oil. Accordingly, the hydraulic fluid S flowing through the hydraulic system 5 is the heat exchanged medium flowing through the second passage R2 of the first heat exchanger 100*a*. Thus, the first heat exchanger 100*a* exchanges heat between the water as the first cooling medium (heat exchanging medium) A and the oil (hydraulic fluid) S as the heat exchanged medium, and the second heat exchanger 100*b* exchanges heat between the water as the first cooling medium (heat exchanging medium) A and the oil as the second cooling medium (heat exchanged medium) B. Accordingly, an oil pump capable of pumping oil having a viscosity higher than the viscosity of water is used as the second pump 110 of the second cooling system 11.

The third cooling system 12 includes an annular passage (circulation passage) through which the third cooling medium C flows. The pump (hereinafter, referred to as a third pump) 121 to deliver (pumping) the third cooling medium C and the fourth heat exchanger 120 are disposed on the circulation passage of the third cooling system 12. The third pump 121 is an electric pump, and has a suction port to suck the third cooling medium C and a delivery port to deliver the third cooling medium C.

To form the circulation passage, the third cooling system 12 includes a first passage pipe 122*a* that connects the delivery port of the third pump 121 and an inlet (IN) of the fourth heat exchanger 120, a second passage pipe 122*b* that connects an outlet (OUT) of the fourth heat exchanger 120 and the inlet (IN) of the internal combustion engine 8, and a third passage pipe 122*c* that connects the outlet (OUT) of the internal combustion engine 8 and the suction port of the third pump 121. Thus, the third cooling system 12 uses the passage (pipeline) of the fourth heat exchanger 120 and the passage of the internal combustion engine 8 as a portion of the circulation passage, and causes the third cooling medium C to circulate therethrough while causing the third cooling medium C to pass through the fourth heat exchanger 120 and the internal combustion engine 8 by the third pump 121 being driven. Note that the third cooling medium C is water (or antifreeze).

As described above, the fourth heat exchanger (radiator) 120 is disposed so as to overlap the third heat exchanger (radiator) 100*c* in the airflow directions of outside air. That is, the third heat exchanger (radiator) 100*c* and the fourth heat exchanger (radiator) 120 are gas-liquid heat exchangers, and hence, are disposed so that the outside air forcibly sent by the cooling fan 104 can pass therethrough in the same direction.

The working machine 1 according to the present example embodiment is as described above, and when the traveling device 2 performs traveling, the driving motor 24 (6*a*) is driven, and hence, the temperatures of the driving motor 24 (6*a*) and the motor inverter 25 (6*b*) increase in accordance with the load of the driving motor 24 (6*a*). Also, when the working device 4 performs work, the internal combustion engine 8 is driven, the power generator 7 is driven, and the hydraulic pump 51 is driven via the power generator 7. Then, the temperature of the internal combustion engine 8 increases in accordance with the load, and the temperatures of the power generator 7 and the power generator inverter 71 (6*c*) increase in accordance with the power generation amount. Also, in the hydraulic system 5, the temperature of the hydraulic fluid S increases in accordance with the load of the hydraulic pump 51 (actions (loads) of the actuators 50*a* and 50*b*).

Accordingly, the working machine 1 (controller 9) drives the first pump 103 of the first cooling system 10, the second pump 110 of the second cooling system 11, and the third pump 121 of the third cooling system 12.

In the first cooling system 10, when the first pump 103 is driven, the first cooling medium A (water) in the cooling medium tank 102 is sucked by the first pump 103 and is sent to the downstream side. The first cooling medium A delivered from the first pump 103 exchanges heat with outside air by air forcibly sent by the cooling fan 104 and is cooled to a set temperature when passing through the third heat exchanger 100*c*. Then, the first cooling medium A cooled to the set temperature through the heat exchange with the outside air is sent to the downstream side, and passes (flows) through the power generator inverter 71 (6*c*), the motor inverter 25 (6*b*), and the driving motor 24 (6*a*) in this order.

Accordingly, the first cooling medium A exchanges heat with the power generator inverter 71 (6*c*), the motor inverter 25 (6*b*), and the driving motor 24 (6*a*), which are in heat generating states, and cools these components. A temperature increase rate (increased temperature) during operation becomes higher in the order of the power generator inverter 71 (6*c*), the motor inverter 25 (6*b*), and the driving motor 24 (6*a*). Hence, the first cooling medium A cools the electric devices 6*a*, 6*b*, and 6*c* in ascending order of cooling temperature, and reduces or minimizes the temperature increase of the first cooling medium A as a result of cooling the plurality of electric devices 6*a*, 6*b*, and 6*c*. That is, the first cooling medium A flows to the downstream side (toward the second heat exchanger 100*b*) while maintaining a temperature in a state in which cooling is possible even on the downstream side (a temperature in a state in which a temperature range necessary for cooling on the downstream side remains) without reaching the boiling point.

In the second cooling system 11, the second pump 110 causes the second cooling medium (oil) B to circulate (flow) through the circulation passage, and when the second cooling medium (oil) B passes through the power generator 7, the second cooling medium B exchanges heat with the power generator 7 in a heat generating state to cool the power generator 7. The second cooling medium B, which has exchanged heat with the power generator 7, passes through the second pump 110 and passes through the second heat exchanger 100*b*. At this time, the second cooling medium B passing through the second heat exchanger 100*b* exchanges heat with the first cooling medium A of the first cooling system 10 and is cooled. The temperature of the second cooling medium B increases through the heat exchange with the power generator 7; however, the temperature of the second cooling medium B is prevented from becoming lower than the temperature of the first cooling medium A because the second cooling medium B is the liquid having the specific heat smaller than the specific heat of the first cooling medium A and the boiling point higher than the boiling point of the first cooling medium A. That is, in the state in which heat is exchanged in the second heat exchanger 100*b*, the temperature of the first cooling medium A is prevented from becoming higher than the temperature of the second cooling medium B, and the first cooling medium A absorbs heat from the second cooling medium B to cool the second cooling medium B in the second heat exchanger 100*b*.

Thus, since the second cooling medium B is caused to circulate (flow) through the circulation passage of the second cooling system 11, the power generator 7 is stably cooled.

Then, the first cooling medium A, which has passed through the second heat exchanger 100*b*, flows to the downstream side (toward the first heat exchanger 100*a*).

When passing through the first heat exchanger 100*a*, the first cooling medium A exchanges heat with the hydraulic fluid S flowing through the hydraulic system 5 and passing through the first heat exchanger 100*a* to cool the hydraulic fluid S. The temperature of the hydraulic fluid S increases in accordance with the workloads (heat amounts) by the actuators 50*a*, 50*b*, and 50*c*; however, the hydraulic fluid S is prevented from becoming lower than the temperature of the first cooling medium A because the hydraulic fluid S is a liquid having a specific heat smaller than the specific heat of the first cooling medium A and a boiling point higher than the boiling point of the first cooling medium A similarly to the second cooling medium B. That is, in the state in which heat is exchanged in the first heat exchanger 100*a*, the temperature of the first cooling medium A is prevented from becoming higher than the temperature of the hydraulic fluid S, and the first cooling medium A absorbs heat from the hydraulic fluid S to cool the hydraulic fluid S in the first heat exchanger 100*a*.

In the hydraulic system 5, there is an appropriate temperature to actuate the actuators 50*a*, 50*b*, and 50*c* as the temperature of the hydraulic fluid S. Excessively cooling the hydraulic fluid S may affect the actions of the actuators 50*a*,

50*b*, and 50*c* and the like. In the present example embodiment, the working machine 1 (hydraulic system 5) includes the temperature sensor 507 that measures the temperature of the hydraulic fluid S in the hydraulic fluid tank 52, and the controller 9 adjusts the opening of the throttle valve 506 based on the measurement result of the temperature sensor 507 to maintain the temperature of the hydraulic fluid S at the appropriate temperature. The throttle valve 506 is an electric fan whose opening is adjusted by driving an electric motor M (see FIG. 2).

Specifically, the hydraulic system 5 includes the bypass 505 that connects the first position P1 located upstream of the first heat exchanger 100*a* and the second position P2 located downstream of the first heat exchanger 100*a*, and the throttle valve 506 is provided in the bypass 505. Accordingly, opening/closing the throttle valve 506 brings the hydraulic fluid S flowing from the upstream side (the control valve unit 53 side) into a state in which the hydraulic fluid S flows through only the second heat exchanger 100*b* and a state in which the hydraulic fluid S flows through the second heat exchanger 100*b* and the bypass 505. Also, adjusting the opening of the throttle valve 506 can change the ratio between the flow rate of the hydraulic fluid S flowing through the second heat exchanger 100*b* and the flow rate of the hydraulic fluid S flowing through the bypass 505.

Thus, in a case where the entire amount of the hydraulic fluid S is caused to flow through the second heat exchanger 100*b* and the temperature of the hydraulic fluid S becomes lower than the appropriate temperature through the heat exchange with the first cooling medium A, when the throttle valve 506 is opened, the hydraulic fluid S flowing through the bypass 505 (the hydraulic fluid S that is not cooled) and the hydraulic fluid S flowing through the second heat exchanger 100*b* (the hydraulic fluid S cooled and lowered in temperature) join in the hydraulic fluid tank 52. Thus, as a result of that adjusting the opening of the throttle valve 506 changes the ratio between the hydraulic fluids S from the two systems, the temperature of the hydraulic fluid S in the hydraulic fluid tank 52 can be set to the appropriate temperature, and the hydraulic system 5 (actuators 50*a* and 50*b*) can be appropriately actuated.

Then, the first cooling medium A, which has exchanged heat with the hydraulic fluid S, returns to the cooling medium tank 102 in a state of having the highest temperature corresponding to the heat amounts, by which the first cooling medium A has sequentially performed cooling (the first cooling medium A has taken heat). Then, the first cooling medium A is sucked again by the first pump 103, passes through the third heat exchanger 100*c*, and is cooled to an initial temperature.

In the third cooling system 12, the third pump 121 causes the third cooling medium C (antifreeze) to circulate (flow) through the circulation passage, and when the third cooling medium C (antifreeze) passes through the internal combustion engine 8, the third cooling medium C exchanges heat with the internal combustion engine 8 in a heat generating state to cool the internal combustion engine 8. The third cooling medium C, which has exchanged heat with the internal combustion engine 8, passes through the third pump 121 and passes through the fourth heat exchanger 120. The fourth heat exchanger 120 is arranged in parallel with the third heat exchanger 100*c*, and hence, the third cooling medium C passing through the fourth heat exchanger 120 exchanges heat with the outside air and is cooled with the air forcibly sent by the cooling fan 104 of the first cooling system 10, similarly to the first cooling medium A of the first cooling system 10. Thus, the third cooling medium C is caused to circulate (flow) through the circulation passage of the third cooling system 12, and hence, the internal combustion engine 8 is stably cooled.

In the working machine 1 according to the present example embodiment, the working device 4 (hydraulic system 5) is switched between a state in which the internal combustion engine 8 drives the hydraulic pump 51 via the power generator 7 and a state in which the power generator 7 functions as a motor by receiving supply of electric power from the battery 70 and drives the hydraulic pump 51. In this case, the temperature of the power generator 7 increases with the drive (load); however, is appropriately cooled with the second cooling medium B of the second cooling system 11, and the second cooling medium B is cooled with the first cooling medium A flowing through the first cooling system 10 (second heat exchanger 100*b*), similarly to the case where the power generator 7 is driven by the internal combustion engine 8.

Thus, the working machine 1 according to the present example embodiment can cool the hydraulic fluid S flowing through the hydraulic system 5 and the second cooling medium (oil) B flowing through the second cooling system 11 to appropriate temperatures with the first cooling medium A flowing through the first cooling system 10.

The working machine 1 according to the present example embodiment is as described above, and the present invention (a preferred example embodiment thereof) provides a working machine 1 described in the following items.

(Item 1) A working machine 1 including a working device 4, a hydraulic system 5 including at least one actuator 50*a*, 50*b*, or 50*c* to actuate the working device 4, and a hydraulic pump 51 to supply a hydraulic fluid S to the actuator 50*a*, 50*b*, or 50*c*, at least one electric device 6*a*, 6*b*, or 6*c*, a power generator 7 to generate electric power to be directly or indirectly supplied to the at least one electric device 6*a*, 6*b*, or 6*c*, a first cooling system 10 to cause a first cooling medium A to circulate therethrough to cool the at least one electric device 6*a*, 6*b*, or 6*c*, and a second cooling system 11 to cause a second cooling medium B to circulate therethrough to cool the power generator 7, wherein the first cooling system 10 includes a first heat exchanger 100*a* to exchange heat between the hydraulic fluid S and the first cooling medium A to cool the hydraulic fluid S, a second heat exchanger 100*b* to exchange heat between the first cooling medium A and the second cooling medium B to cool the second cooling medium B, and a third heat exchanger 100*c* to exchange heat between the first cooling medium A and outside air to cool the first cooling medium A so that a temperature of the first cooling medium A becomes lower than temperatures before the heat exchange of the hydraulic fluid S and the second cooling medium B.

According to the working machine 1 of Item 1, the first cooling medium A circulating (flowing) through the first cooling system 10 exchanges heat with the outside air in the third heat exchanger 100*c* and hence, is cooled to an appropriate temperature (a temperature at which each component can be cooled to an appropriate temperature). Accordingly, even when the temperatures of the electric devices 6*a*, 6*b*, and 6*c* increase (or will increase) with driving (actuation), the electric devices 6*a*, 6*b*, and 6*c* are cooled with the first cooling medium A, which has been heat-exchanged (cooled) in the third heat exchanger 100*c*, and operate at appropriate temperatures (are not overloaded). Also, the temperature of the hydraulic fluid S flowing (circulating) through the hydraulic system 5 increases by work of the hydraulic pump 51 and the actuators 50*a*, 50*b*, and 50*c*, and the temperature of the second cooling medium B flowing (circulating) through the second cooling system 11 increases through the heat exchange with (cooling of) the power generator 7. However, the first cooling medium A flowing through the first cooling system 10 exchanges heat with the hydraulic fluid S in the first heat exchanger 100*a* and exchanges heat with the second cooling medium B in the second heat exchanger 100*b*, thereby cooling the hydraulic fluid S and the second cooling medium B to appropriate temperatures.

Thus, the heat exchangers (first heat exchanger 100*a*, second heat exchanger 100*b*) to cool (heat-exchange) the hydraulic fluid S of the hydraulic system 5 and the second cooling medium B of the second cooling system 11 do not need to exchange heat with the outside air. That is, it is not necessary to dispose the heat exchangers at positions at which the outside air can be taken in. Thus, the flexibility of the arrangement of the heat exchangers (first heat exchanger 100*a*, second heat exchanger 100*b*) increases by adjusting routing of pipes of the respective systems, and the plurality of cooling systems including the hydraulic system 5 can be made compact.

(Item 2) The working machine 1 according to Item 1, wherein the hydraulic system 5 includes a hydraulic fluid tank 52 to store the hydraulic fluid S, a primary system 5A connecting the actuator 50*a*, 50*b*, or 50*c* and the hydraulic fluid tank 52 via the hydraulic pump 51, to supply the hydraulic fluid S stored in the hydraulic fluid tank 52 to the actuator 50*a*, 50*b*, or 50*c* by drive of the hydraulic pump 51, and a secondary system 5B connecting the actuator 50*a*, 50*b*, 50*c* and the hydraulic fluid tank 52, to return the hydraulic fluid S from the actuator 50*a*, 50*b*, or 50*c* to the hydraulic fluid tank 52, and the first heat exchanger 100*a* is included in the secondary system 5B, to exchange heat between the hydraulic fluid S flowing through the secondary system 5B and the first cooling medium A.

According to the working machine 1 of Item 2, the first heat exchanger 100*a* is included in the secondary system 5B through which the hydraulic fluid S having a temperature increased by the work (operation) of the hydraulic pump 51 and the actuators 50*a*, 50*b*, and 50*c* flows. Hence, the hydraulic fluid S can be cooled before the hydraulic fluid S returns to the hydraulic fluid tank 52 through the heat exchange between the hydraulic fluid S and the first cooling medium A in the first heat exchanger 100*a*. Thus, the hydraulic fluid S stored in the hydraulic fluid tank 52 can be prevented from being overheated, and the hydraulic pump 51 sucks the hydraulic fluid S at the appropriate temperature from the hydraulic fluid tank 52 and supplies the hydraulic fluid S to the actuators 50*a*, 50*b*, and 50*c*.

(Item 3) The working machine 1 according to Item 2, wherein the hydraulic system 5 includes a temperature sensor 507 to measure a temperature of the hydraulic fluid S in the hydraulic fluid tank 52, and a bypass 505 connecting a first position P1 located upstream of the first heat exchanger 100*a* on the secondary system 5B and a second position P2 located downstream of the first heat exchanger 100*a*, and the bypass 505 includes a throttle valve 506 to adjust a flow rate of the hydraulic fluid S so that a measurement result of the temperature sensor 507 becomes an appropriate temperature of the hydraulic fluid S.

According to the working machine 1 of Item 3, opening/closing the throttle valve 506 can bring the hydraulic fluid S into a state in which the hydraulic fluid S flows through only the first heat exchanger 100*a* and a state in which the hydraulic fluid S flows through both the first heat exchanger 100*a* and the bypass 505. Also, adjusting the opening of the throttle valve 506 can change the ratio between the flow rate of the hydraulic fluid S flowing through the first heat exchanger 100*a* and the flow rate of the hydraulic fluid S flowing through the bypass 505. That is, the ratio between the hydraulic fluid S cooled (heat-exchanged) in the first heat exchanger 100*a* and the hydraulic fluid S flowing through the bypass 505 can be changed.

Since the hydraulic fluid S flowing through the first heat exchanger 100*a* and the hydraulic fluid S passing through the bypass 505 join (mix) in the hydraulic fluid tank 52, the temperature sensor 507 measures the temperature of the hydraulic fluid S in the hydraulic fluid tank 52, and the opening (flow rate) of the throttle valve 506 is adjusted so that the temperature becomes the appropriate temperature for the hydraulic fluid S. Hence, it is possible to prevent the hydraulic fluid S from being excessively cooled (falling below the appropriate temperature for operating the hydraulic system 5). Thus, the hydraulic system 5 (actuators 50*a*, 50*b*, 50*c*, hydraulic pump 51) can exhibit a predetermined capacity.

(Item 4) The working machine 1 according to any one of Items 1 to 3, wherein the at least one electric device 6*a*, 6*b*, or 6*c* includes a plurality of electric devices 6*a*, 6*b*, and/or 6*c*, and the plurality of electric devices 6*a*, 6*b*, and/or 6*c* are included in the first cooling system 10 and cooled in ascending order of heat resistance and heat generation temperature during operation from an upstream side to a downstream side in a flow direction of the first cooling medium A.

According to the working machine 1 of Item 4, the plurality of electric devices 6*a*, 6*b*, and 6*c* are included in the first cooling system 10 in the ascending order of the heat resistance and the heat generation temperature during the operation from the upstream side to the downstream side in the flow direction of the first cooling medium A. Hence, the electric device 6*a*, 6*b*, or 6*c* having a low heat resistance can be preferentially cooled, and occurrence of a failure of the electric device 6*a*, 6*b*, or 6*c* having the low heat resistance can be suppressed. Also, the electric device 6*a*, 6*b*, or 6*c* located on a more upstream side of the first cooling system 10 generates heat at a lower heat generation temperature during operation, and Hence, the increase in temperature of the first cooling medium A as a result of taking heat from the electric device 6*a*, 6*b*, or 6*c* is small (temperature range is narrow). Thus, the first cooling medium A flows to the downstream side with a margin for taking heat from the electric device 6*a*, 6*b*, or 6*c* located on the downstream side. Thus, when the plurality of electric devices 6*a*, 6*b*, and/or 6*c* are cooled with the first cooling medium A, it is possible to prevent a situation in which the electric device 6*a*, 6*b*, or 6*c* disposed on the downstream side cannot be cooled.

(Item 5) The working machine 1 according to Item 4, including as the plurality of electric devices 6*a*, 6*b*, an electric motor 24, and an inverter 25 to drive the electric motor 24, wherein the electric motor 24 and the inverter 25 are included in the first cooling system 10, and the inverter 25 is located upstream of the electric motor 24 in the flow direction of the first cooling medium A.

According to the working machine 1 of Item 5, since the inverter 25 has a lower heat resistance than the heat resistance of the electric motor 24, the inverter 25 is located upstream of the electric motor 24 as described above, and hence, the inverter 25 having the lower heat resistance can be preferentially heat-exchanged (cooled). Thus, it is possible to reduce or prevent a failure of the inverter 25 due to overheating.

(Item 6) The working machine 1 according to any one of Items 1 to 5, including a power generator inverter 71 to drive the power generator 7, as the electric device 6*c*, wherein the power generator inverter 71 is included in the first cooling system 10.

According to the working machine 1 of Item 6, since the power generator inverter 71 has a low heat resistance similarly to the motor inverter 25, the power generator inverter 71 is included in the first cooling system 10, and hence, it is possible to reduce or prevent a failure due to overheating of the power generator inverter 71.

(Item 7) The working machine 1 according to any one of Items 1 to 6, wherein the second cooling medium B is a liquid having a specific heat smaller than a specific heat of the first cooling medium A and a boiling point higher than a boiling point of the first cooling medium A.

According to the working machine 1 of Item 7, even when the first cooling medium A flows through the first cooling system 10 and the temperature of the first cooling medium A increases as a result of cooling the electric devices 6*a*, 6*b*, and 6*c*, it is possible to prevent the temperature of the first cooling medium A from exceeding the temperature of the second cooling medium B. That is, it is possible to prevent a situation in which the temperature of the first cooling medium A becomes higher than the temperature of the second cooling medium B before the first cooling medium A reaches the second heat exchanger 100*b*, and the second cooling medium B cannot be cooled (heat cannot be taken from the second cooling medium B).

(Item 8) The working machine (1) according to claim 7, wherein the first cooling medium (A) is water, and the second cooling medium (B) is oil.

According to the working machine 1 of Item 8, the first cooling medium A and the second cooling medium B are not special, and are easily handled.

(Item 9) The working machine (1) according to claim 1, wherein the first heat exchanger (100*a*) is located downstream of the second heat exchanger (100*b*) and upstream of the third heat exchanger (100*c*), and the second heat exchanger (100*b*) is located downstream of the electric device (6*a*, 6*b*, 6*c*).

According to the working machine 1 of Item 9, the workload (heat generation amount) of the power generator 7 is larger than the workloads (heat generation amounts) of the electric devices 6*a*, 6*b*, and 6*c*, and the workload (heat generation amount) of the hydraulic system 5 (hydraulic pump 51 and actuators 50*a*, 50*b*, and 50*c*) is larger than the workload (heat generation amount) of the power generator 7. Thus, the temperature increase of the second cooling medium B is larger than the temperature increases of the electric devices 6*a*, 6*b*, and 6*c*, and the temperature increase of the hydraulic fluid S is larger than the temperature increase of the second cooling medium B.

Thus, since the first heat exchanger 100*a* is located downstream of the second heat exchanger 100*b*, and the second heat exchanger 100*b* is located downstream of the electric devices 6*a*, 6*b*, and 6*c*, the electric devices 6*a*, 6*b*, and 6*c*, the second cooling medium B, and the hydraulic fluid S can be appropriately cooled while the temperature increase of the first cooling medium A as a result of cooling a target is reduced or prevented. Also, since the first heat exchanger 100*a* is located upstream of the third heat exchanger 100*c*, the first cooling medium A having the most increased temperature in the first cooling system 10 can be heat-exchanged (cooled) in the third heat exchanger 100*c*. Thus, the electric devices 6*a*, 6*b*, and 6*c* on the first cooling system 10, the second cooling medium B, and the hydraulic fluid S can be appropriately cooled.

(Item 10) The working machine (1) according to any one of claims 1 to 9, including an internal combustion engine (8) to drive the power generator (7), and a third cooling system (12) to cause a third cooling medium (C) to circulate therethrough to cool the internal combustion engine (8), wherein the third cooling system (12) includes a fourth heat exchanger (120) to exchange heat between the third cooling medium (C) and outside air, the fourth heat exchanger (120) being provided in parallel with the third heat exchanger (100*c*), and at least one of the first cooling system (10) and the third cooling system (12) includes a cooling fan (104) to send the outside air toward the third heat exchanger (100*c*) and the fourth heat exchanger (120).

According to the working machine 1 of Item 10, the temperature of the third cooling medium C flowing (circulating) through the third cooling system 12 increases with drive (work) of the internal combustion engine 8; however, the third cooling medium C is cooled through the heat exchange with the outside air when passing through the fourth heat exchanger 120 and circulates through the third cooling system 12 while continuously cooling the internal combustion engine 8. Also, the at least one of the first cooling system 10 and the third cooling system 12 includes the cooling fan 104 to send the outside air toward the third heat exchanger 100*c* and the fourth heat exchanger 120. Hence, the air forcibly sent by the cooling fan 104 increases heat exchange efficiency (cooling efficiency) of the third cooling medium C.

Further, the third heat exchanger 100*c* is provided in parallel with the fourth heat exchanger 120. Hence, the air forcibly sent by the single cooling fan 104 can increase the heat exchange efficiency (cooling efficiency) of not only the third cooling medium C flowing (circulating) through the third cooling system 12 but also the first cooling medium A flowing (circulating) through the first cooling system 10. Also, the cooling fan 104 included in at least one of the first cooling system 10 and the third cooling system 12 is a common cooling fan 104 that cools a heat exchanger in a system other than the system to which the cooling fan 104 belongs. Hence, the occupancy of the cooling fan 104 can be reduced. That is, the cooling system can be made compact.

(Item 11) The working machine 1 according to Item 10, wherein the power generator 7 is a motor generator that includes an output shaft to transmit drive to the hydraulic pump 51, and that is switchable between a power generation state in which the motor generator generates electric power by receiving drive of the internal combustion engine 8 and a drive state in which the motor generator is driven to rotate by receiving supply of electric power, and the power generator 7 drives the hydraulic pump 51 via the output shaft in the power generation state and the drive state.

According to the working machine 1 of Item 11, the power generator 7 is the motor generator to be switchable between the power generation state in which the motor generator generates the electric power by receiving the drive of the internal combustion engine 8 and the drive state in which the motor generator is driven to rotate by receiving the supply of the electric power. Hence, the working machine 1 is a working machine that relies on not only the drive of the internal combustion engine 8. That is, the working machine 1 is a hybrid working machine capable of driving with the internal combustion engine 8 and the power generator 7 selectively or in combination.

(Item 12) The working machine 1 according to any one of Items 1 to 11, wherein each of the first cooling medium A and the second cooling medium B is a liquid, the first heat exchanger 100*a* and the second heat exchanger 100*b* are liquid-cooled heat exchangers to exchange heat between liquids, and the third heat exchanger 100*c* is an air-cooled heat exchanger to exchange heat between a gas and a liquid.

According to the working machine 1 of Item 12, although the third heat exchanger 100*c* is the air-cooled heat exchanger that exchanges heat between the gas and the liquid, the first heat exchanger 100*a* and the second heat exchanger 100*b* are the liquid-cooled heat exchangers that exchange heat between the liquids. Hence, the working machine 1 can be made compact.

(Item 13) The working machine 1 according to Item 12, wherein each of the liquid-cooled heat exchangers 100*a* and 100*b* is a plate-shaped heat exchanger in which a plurality of heat transfer plates 101 are stacked, and a first passage R1 through which a heat exchanging medium A flows and a second passage R2 through which a heat exchanged medium S, B flows are alternately formed with each of the heat transfer plates 101 as a boundary, in the first heat exchanger 100*a*, the first cooling medium A is caused to flow as the heat exchanging medium through the first passage R1, and the hydraulic fluid S is caused to flow as the heat exchanged medium through the second passage R2, and in the second heat exchanger 100*b*, the first cooling medium A is caused to flow as the heat exchanging medium through the first passage R1, and the second cooling medium B is caused to flow as the heat exchanged medium through the second passage R2.

According to the working machine 1 of Item 13, the first heat exchanger 100*a* and the second heat exchanger 100*b* each are the plate-shaped heat exchanger including the plurality of stacked heat transfer plates 101, and the first passage R1 through which the heat exchanging medium A flows and the second passage R2 through which the heat exchanged medium S or B flows are alternately formed with each of the heat transfer plates 101 as the boundary. Hence, the first heat exchanger 100*a* and the second heat exchanger 100*b* can be made compact.

Also, the first heat exchanger 100*a* can attain high heat exchange efficiency between the first cooling medium A and the hydraulic fluid S, and the second heat exchanger 100*b* can attain high heat exchange efficiency between the first cooling medium A and the second cooling medium B. That is, in the plate-shaped heat exchangers 100*a* and 100*b*, facing surfaces of the adjacent heat transfer plates 101 serve as heat transfer surfaces. Hence, heat exchange efficiency is high, and efficient cooling is possible.

Note that the present invention is not limited to the above-described example embodiments, and appropriate modifications can be made without departing from the scope of the present invention.

For example, in the above-described example embodiments, the track loader (compact track loader) has been described as an example of the working machine 1. However, the working machine 1 is not limited to the track loader (compact track loader). The working machine 1 may be an agricultural machine, a construction machine, a utility vehicle (UV), or the like. More specifically, the working machine 1 may be a tractor, a skid-steer loader, a wheel loader, a backhoe, or the like.

In the above-described example embodiments, the ride-on working machine 1 has been described. However, this does not imply any limitation. For example, the working machine 1 may be remotely operated by an operator outside the working machine 1. Also, the working machine 1 may operate autonomously by the controller 9 included in the working machine 1.

In the above-described example embodiments, the crawler traveling device is used as the traveling device 2. However, this does not imply any limitation. For example, the traveling device 2 may be a tire traveling device or a combined traveling device as a combination of a tire traveling device and a crawler traveling device. The tire traveling device includes a pair of front wheels disposed on both left and right sides of a front portion in an advancing direction, and a pair of rear wheels disposed on both left and right sides of a rear portion in the advancing direction. At least ones of the front wheels and the rear wheels serve as steering wheels that determine the traveling direction, and at least others of the front wheels and the rear wheels serve as driving wheels that are driven to rotate by receiving drive from a drive source.

In the combined traveling device, one of the front portion and the rear portion in the advancing direction includes the tire traveling device, and another one of the front portion and the rear portion in the advancing direction includes the crawler traveling device. In this case, the tire traveling device includes a pair of left and right wheels (tires) that serve as steering wheels. The crawler traveling device is configured similarly to the traveling device 2 of the above-described example embodiments and is disposed on each of both left and right sides of the machine body 3. Note that the drive source of the traveling device 2 may be an electric motor or an internal combustion engine (engine) similarly to the above-described example embodiments. However, it is premised that the working machine 1 includes the electric motor of the traveling device 2 or other electric devices 6*a*, 6*b*, and 6*c* as the electric devices 6*a*, 6*b*, and 6*c*, and the electric devices 6*a*, 6*b*, and 6*c* are cooled by the first cooling system 10. Note that, when the working machine 1 includes a plurality of electric devices 6*a*, 6*b*, and 6*c*, the plurality of electric devices 6*a*, 6*b*, and 6*c* are included in the first cooling system 10 and cooled in ascending order of heat resistance and heat generation temperature during operation from the upstream side to the downstream side in the flow direction of the first cooling medium A.

In the above-described example embodiments, the driving motor (electric motor) 24, the motor inverter (inverter) 25, and the power generator inverter 71 are provided as the electric devices 6*a*, 6*b*, and 6*c* on the first cooling system 10. However, this does not imply any limitation. For example, another electric device may be included in the first cooling system 10 in addition to the driving motor (electric motor) 24, the motor inverter (inverter) 25, and the power generator inverter 71, or another electric device may be included in the first cooling system 10 instead of the driving motor (electric motor) 24, the motor inverter (inverter) 25, and the power generator inverter 71. That is, at least one electric device may be included in the first cooling system 10 in consideration of the necessity of cooling.

In the above-described example embodiments, the power generator (motor generator) 7 drives the hydraulic pump 51. However, this does not imply any limitation. The power generator (motor generator) 7 may drive a device other than the hydraulic pump 51. That is, the second cooling system 11 may cool the power generator (motor generator) 7 that drives a device other than the hydraulic pump 51.

Also, in the above-described example embodiments, the power generator 7 functions as the motor that drives the hydraulic pump 51. However, this does not imply any limitation. For example, the power generator 7 may have only a function of a power generator that generates electric power to be supplied to the electric devices 6*a*, 6*b*, and 6*c*.

Thus, the second cooling system 11 may cool the power generator 7 having only the function of the power generator 7.

In the above-described example embodiments, the diesel engine is used as the internal combustion engine 8. However, this does not imply any limitation. For example, the internal combustion engine 8 may be a gasoline engine, an LPG engine, or the like.

In the above-described example embodiments, in each of the second cooling system 11 and the third cooling system 12, the cooling medium (second cooling medium B, third cooling medium C) sent by the pump (second pump 110, third pump 121) flows through the annular passage (circulation passage) and directly returns to the pump (second pump 110, third pump 121). However, this does not imply any limitation. For example, in each of the second cooling system 11 and the third cooling system 12, a tank that stores the cooling medium (second cooling medium B, third cooling medium C) or a pocket in which the cooling medium (second cooling medium B, third cooling medium C) is stored may be located upstream of the pump (second pump 110, third pump 121). The cooling medium (second cooling medium B, third cooling medium C) stored in the tank or the pocket may be sucked by the pump (second pump 110, third pump 121) and delivered toward the second heat exchanger 100*b*.

In the above-described example embodiments, the three-phase AC synchronous motor including one or more permanent magnets is used as the power generator (motor generator) 7. However, this does not imply any limitation. For example, the power generator (motor generator) 7 may be another type synchronous motor, and may be an AC motor or a DC motor.

In the above-described example embodiments, although the plate-shaped heat exchangers used as the first heat exchanger 100*a* and the second heat exchanger 100*b* are not particularly mentioned, in the case of using the plate-shaped heat exchangers, the plate-shaped heat exchangers may be a brazed heat exchanger in which the adjacent heat transfer plates 101 and 101 are sealed by brazing, or of a gasket heat exchanger in which a gasket is interposed between the adjacent heat transfer plates 101 and 101, in order to define the first passage R1, the second passage R2, the inflow passages Ra1 and Rb1, and the outflow passages Ra2 and Rb2.

In the above-described example embodiments, the first heat exchanger 100*a* and the second heat exchanger 100*b* include the plate-shaped heat exchangers as the liquid-cooled heat exchangers. However, this does not imply any limitation. For example, the first heat exchanger 100*a* and the second heat exchanger 100*b* each may include a multiple-pipe heat exchanger on the premise of a liquid-cooled heat exchanger.

Figure 7:
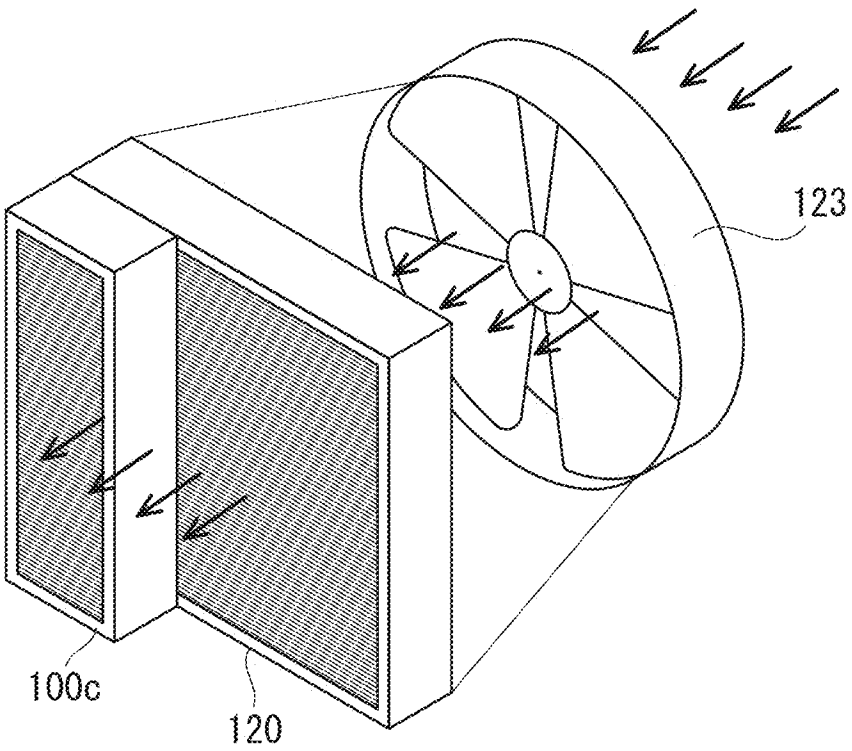
FIG. 7 is a schematic perspective view for explaining arrangement of a third heat exchanger, a fourth heat exchanger, and a cooling fan of a working machine according to another example embodiment of the present invention.

In the above-described example embodiments, the first cooling system 10 includes the cooling fan 104 that sends outside air to the third heat exchanger 100*c* and the fourth heat exchanger 120. However, this does not imply any limitation. For example, as illustrated in FIG. 7, the third cooling system 12 may include a cooling fan 123 that sends outside air to the third heat exchanger 100*c* and the fourth heat exchanger 120. In this case, similarly to the above-described example embodiments, the cooling fan 123 may be a suction fan that sucks outside air from the side of the third heat exchanger 100*c* and the fourth heat exchanger 120, or may be a pushing fan that pushes outside air toward the third heat exchanger 100*c* and the fourth heat exchanger 120, as illustrated in FIG. 7.

Figure 8:
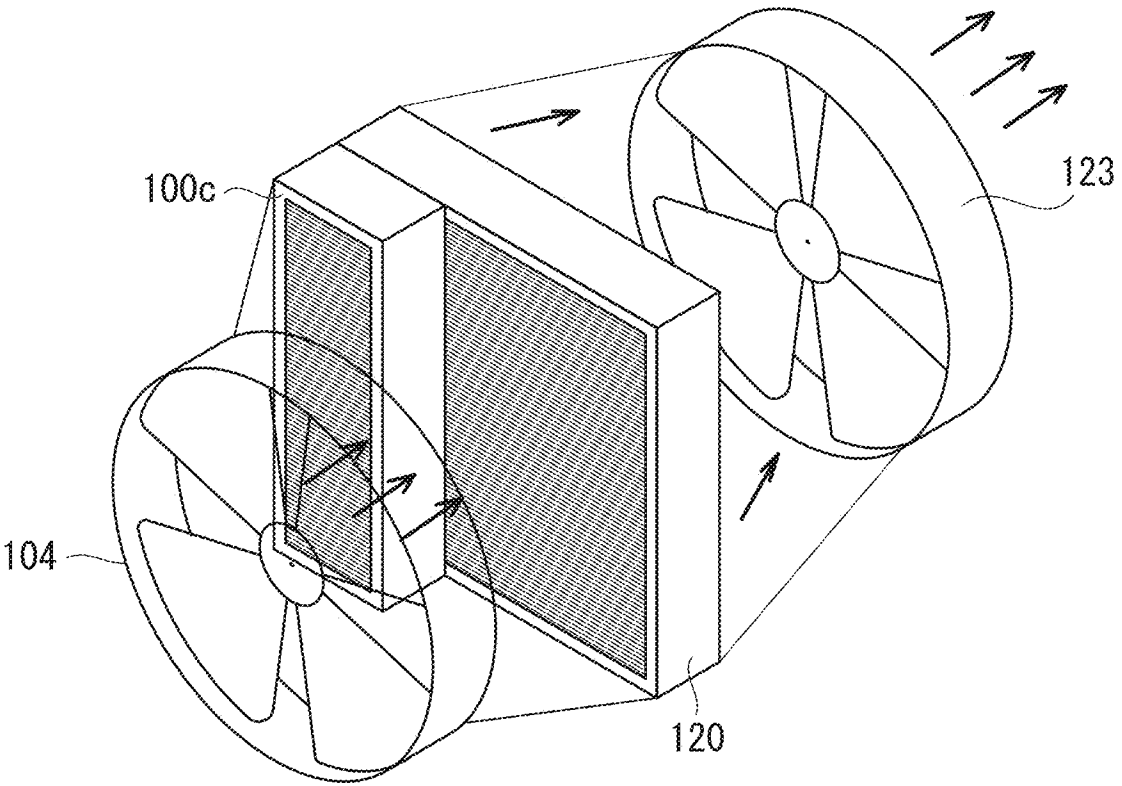
FIG. 8 is a schematic perspective view for explaining arrangement of a third heat exchanger, a fourth heat exchanger, and cooling fans of a working machine according to still another example embodiment of the present invention.

Also, as illustrated in FIG. 8, the first cooling system 10 and the third cooling system 12 may respectively include the cooling fans 104 and 123 that send outside air to the third heat exchanger 100*c* and the fourth heat exchanger 120. In this case, the cooling fan 104 of the first cooling system 10 may be a suction fan that sucks outside air from the side of the third heat exchanger 100*c* and the fourth heat exchanger 120, and the cooling fan 123 of the third cooling system 12 may be a pushing fan that pushes outside air toward the third heat exchanger 100*c* and the fourth heat exchanger 120, so that the airflow directions of the outside air coincide with each other. Alternatively, as illustrated in FIG. 8, the cooling fan 123 of the third cooling system 12 may be a suction fan that sucks outside air from the side of the third heat exchanger 100*c* and the fourth heat exchanger 120, and the cooling fan 104 of the first cooling system 10 may be a pushing fan that pushes outside air toward the third heat exchanger 100*c* and the fourth heat exchanger 120.

Even in this case, the cooling fan 104 or 123 in a system thereof is commonly used for cooling the heat exchanger 100*c* or 120 in another system.

Figure 9:
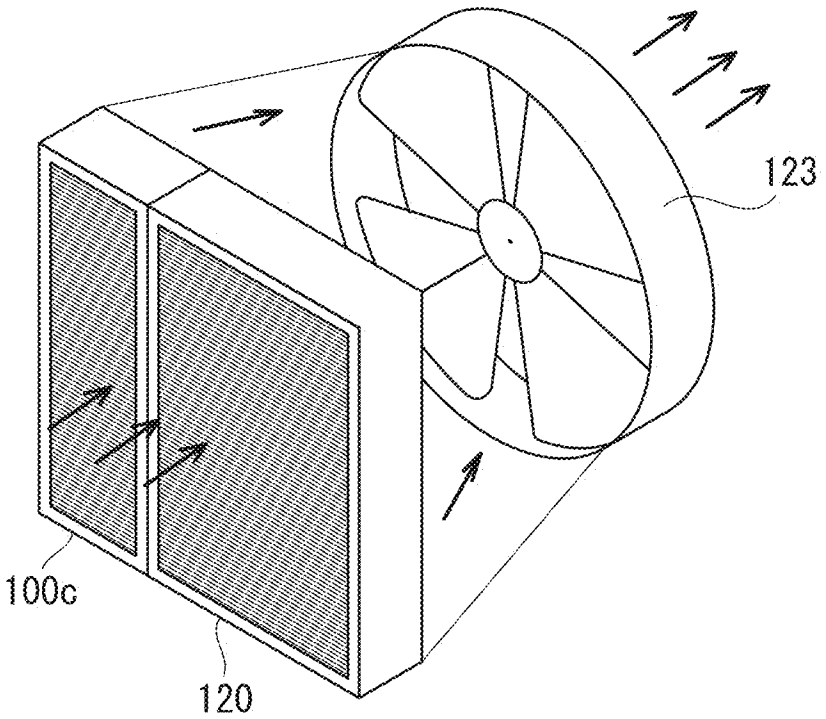
FIG. 9 is a schematic perspective view for explaining arrangement of a third heat exchanger, a fourth heat exchanger, and a cooling fan of a working machine according to yet another example embodiment of the present invention.

In the above-described example embodiments, the third heat exchanger 100*c* and the fourth heat exchanger 120 are disposed to overlap in the airflow directions of the outside air so that the air passages (gaps between the fins) of the third heat exchanger 100*c* and the fourth heat exchanger 120 are continuous in the same direction. However, this does not imply any limitation. For example, as illustrated in FIG. 9, the third heat exchanger 100*c* and the fourth heat exchanger 120 may be arranged side by side in a direction orthogonal to the airflow directions of the outside air. That is, the third heat exchanger 100*c* and the fourth heat exchanger 120 may be disposed to overlap in the airflow directions of the outside air or may be arranged side by side in the direction orthogonal to the airflow directions of the outside air as long as the airflow directions coincide with each other. Even in this case, either one of the first cooling system 10 and the third cooling system 12 may include the common cooling fan 104 or 123 that is a pushing fan that pushes outside air toward the third heat exchanger 100*c* and the fourth heat exchanger 120 or a suction fan that sucks outside air from the side of the third heat exchanger 100*c* and the fourth heat exchanger 120. Note that the cooling fan 123 illustrated in FIG. 9 is a suction fan included in the third cooling system 12.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a working device;

a hydraulic system including an actuator to actuate the working device, and a hydraulic pump to supply a hydraulic fluid to the actuator;

at least one electric device;

a power generator to generate electric power to be directly or indirectly supplied to the at least one electric device;

a first cooling system to cause a first cooling medium to circulate therethrough to cool the at least one electric device; and a second cooling system to cause a second cooling medium to circulate therethrough to cool the power generator; wherein the first cooling system includes:

a first heat exchanger to exchange heat between the hydraulic fluid and the first cooling medium to cool the hydraulic fluid;

a second heat exchanger to exchange heat between the first cooling medium and the second cooling medium to cool the second cooling medium; and a third heat exchanger to exchange heat between the first cooling medium and outside air to cool the first cooling medium so that a temperature of the first cooling medium becomes lower than temperatures before the heat exchange of the hydraulic fluid and the second cooling medium.

2. The working machine according to claim 1, wherein the hydraulic system includes:

a hydraulic fluid tank to store the hydraulic fluid;

a primary system connecting the actuator and the hydraulic fluid tank via the hydraulic pump, to supply the hydraulic fluid stored in the hydraulic fluid tank to the actuator by driving the hydraulic pump; and a secondary system connecting the actuator and the hydraulic fluid tank, to return the hydraulic fluid from the actuator to the hydraulic fluid tank; and the first heat exchanger is included in the secondary system, to exchange heat between the hydraulic fluid flowing through the secondary system and the first cooling medium.

3. The working machine according to claim 2, wherein the hydraulic system includes:

a temperature sensor to measure a temperature of the hydraulic fluid in the hydraulic fluid tank; and a bypass connecting a first position located upstream of the first heat exchanger on the secondary system and a second position located downstream of the first heat exchanger, the bypass including a throttle valve to adjust a flow rate of the hydraulic fluid so that a measurement result of the temperature sensor becomes an appropriate temperature of the hydraulic fluid.

4. The working machine according to claim 1, wherein the at least one electric device includes a plurality of electric devices; and the plurality of electric devices are included in the first cooling system and cooled in ascending order of heat resistance and heat generation temperature during operation from an upstream side to a downstream side in a flow direction of the first cooling medium.

5. The working machine according to claim 2, wherein the at least one electric device includes a plurality of electric devices; and the plurality of electric devices are included in the first cooling system and cooled in ascending order of heat resistance and heat generation temperature during operation from an upstream side to a downstream side in a flow direction of the first cooling medium.

6. The working machine according to claim 3, wherein the at least one electric device includes a plurality of electric devices; and the plurality of electric devices are included in the first cooling system and cooled in ascending order of heat resistance and heat generation temperature during operation from an upstream side to a downstream side in a flow direction of the first cooling medium.

7. The working machine according to claim 4, wherein the plurality of electric devices include:

an electric motor; and an inverter to drive the electric motor;

the electric motor and the inverter are included in the first cooling system; and the inverter is located upstream of the electric motor in the flow direction of the first cooling medium.

8. The working machine according to claim 1, wherein the at least one electric device includes a power generator inverter to drive the power generator; and the power generator inverter is included in the first cooling system.

9. The working machine according to claim 2, wherein the at least one electric device includes a power generator inverter to drive the power generator; and the power generator inverter is included in the first cooling system.

10. The working machine according to claim 3, wherein the at least one electric device includes a power generator inverter to drive the power generator; and the power generator inverter is included in the first cooling system.

11. The working machine according to claim 1, wherein the second cooling medium is a liquid having a specific heat smaller than a specific heat of the first cooling medium and a boiling point higher than a boiling point of the first cooling medium.

12. The working machine according to claim 11, wherein the first cooling medium is water; and the second cooling medium is oil.

13. The working machine according to claim 1, wherein the first heat exchanger is located downstream of the second heat exchanger and upstream of the third heat exchanger; and the second heat exchanger is located downstream of the electric device.

14. The working machine according to claim 2, wherein the first heat exchanger is located downstream of the second heat exchanger and upstream of the third heat exchanger; and the second heat exchanger is located downstream of the electric device.

15. The working machine according to claim 3, wherein the first heat exchanger is located downstream of the second heat exchanger and upstream of the third heat exchanger; and the second heat exchanger is located downstream of the electric device.

16. The working machine according to claim 4, wherein the first heat exchanger is located downstream of the second heat exchanger and upstream of the third heat exchanger; and the second heat exchanger is located downstream of the electric device.

17. The working machine according to claim 1, further comprising:

an internal combustion engine to drive the power generator; and a third cooling system to cause a third cooling medium to circulate therethrough to cool the internal combustion engine; wherein the third cooling system includes a fourth heat exchanger to exchange heat between the third cooling medium and outside air, the fourth heat exchanger being provided in parallel with the third heat exchanger; and at least one of the first cooling system and the third cooling system includes a cooling fan to send the outside air toward the third heat exchanger and the fourth heat exchanger.

18. The working machine according to claim 17, wherein the power generator is a motor generator that includes an output shaft to transmit drive to the hydraulic pump, and that is switchable between a power generation state in which the motor generator generates electric power by receiving a drive of the internal combustion engine and a drive state in which the motor generator is driven to rotate by receiving supply of electric power, and the power generator drives the hydraulic pump via the output shaft in the power generation state and the drive state.

19. The working machine according to claim 1, wherein each of the first cooling medium and the second cooling medium is a liquid;

the first heat exchanger and the second heat exchanger are liquid-cooled heat exchangers to exchange heat between liquids; and the third heat exchanger is an air-cooled heat exchanger to exchange heat between a gas and a liquid.

20. The working machine according to claim 19, wherein each of the liquid-cooled heat exchangers is a plate-shaped heat exchanger in which a plurality of heat transfer plates are stacked, and a first passage through which a heat exchanging medium flows and a second passage through which a heat exchanged medium flows are alternately formed with each of the heat transfer plates as a boundary;

in the first heat exchanger, the first cooling medium is caused to flow as the heat exchanging medium through the first passage, and the hydraulic fluid is caused to flow as the heat exchanged medium through the second passage; and in the second heat exchanger, the first cooling medium is caused to flow as the heat exchanging medium through the first passage, and the second cooling medium is caused to flow as the heat exchanged medium through the second passage.

* * * * *